US011244602B2

(12) United States Patent
Zheng et al.

(10) Patent No.: US 11,244,602 B2
(45) Date of Patent: Feb. 8, 2022

(54) SHIFT REGISTER AND METHOD FOR DRIVING THE SAME, LIGHT-EMITTING CONTROL CIRCUIT AND DISPLAY APPARATUS

(71) Applicant: BOE TECHNOLOGY GROUP CO., LTD., Beijing (CN)

(72) Inventors: Haoliang Zheng, Beijing (CN); Dongni Liu, Beijing (CN); Minghua Xuan, Beijing (CN); Zhenyu Zhang, Beijing (CN); Li Xiao, Beijing (CN); Liang Chen, Beijing (CN); Hao Chen, Beijing (CN); Guangliang Shang, Beijing (CN); Lijun Yuan, Beijing (CN); Xing Yao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/086,097

(22) Filed: Oct. 30, 2020

(65) Prior Publication Data

US 2021/0193027 A1 Jun. 24, 2021

(30) Foreign Application Priority Data

Dec. 18, 2019 (CN) ..... 201922283454.5

(51) Int. Cl.
*G09G 3/32* (2016.01)

(52) U.S. Cl.
CPC ..... *G09G 3/32* (2013.01); *G09G 2310/0286* (2013.01); *G09G 2310/08* (2013.01)

(58) Field of Classification Search
CPC ..... G09G 2310/0286; G09G 3/32; G09G 2310/08
See application file for complete search history.

(56) References Cited

U.S. PATENT DOCUMENTS

| | | | | |
|---|---|---|---|---|
| 2019/0311691 | A1* | 10/2019 | Feng | G09G 3/3677 |
| 2020/0027515 | A1* | 1/2020 | Gu | G09G 3/20 |
| 2020/0090610 | A1* | 3/2020 | Wang | G09G 3/3677 |
| 2020/0302844 | A1* | 9/2020 | Huang | G09G 3/20 |

* cited by examiner

*Primary Examiner* — Muhammad N Edun
(74) *Attorney, Agent, or Firm* — Procopio, Cory, Hargreaves & Savitch, LLP

(57) ABSTRACT

A shift register includes an input sub-circuit, a control sub-circuit, an output sub-circuit and a reset sub-circuit. The input sub-circuit is configured to transmit an input signal from an input signal terminal to a pull-up node. The control sub-circuit is configured to transmit a clock signal from a clock signal terminal to the control node. The output sub-circuit is configured to transmit a second voltage signal from a second voltage signal terminal to a first output signal terminal, and to transmit a first voltage signal from a first voltage signal terminal to the first output signal terminal. The reset sub-circuit is configured to transmit the second voltage signal to the control node to reset the control node, and to transmit a third voltage signal from the third voltage signal terminal to the pull-up node to reset the pull-up node.

19 Claims, 19 Drawing Sheets

SHIFT REGISTER AND METHOD FOR DRIVING THE SAME, LIGHT-EMITTING CONTROL CIRCUIT AND DISPLAY APPARATUS

CROSS-REFERENCE TO RELATED APPLICATION

This application claims priority to Chinese Patent Application No. 201922283454.5, filed on Dec. 18, 2019, which is incorporated herein by reference in its entirety.

TECHNICAL FIELD

The present disclosure relates to the field of display technologies, and in particular, to a shift register and a method for driving the same, a light-emitting control circuit and a display apparatus.

BACKGROUND

A self-luminous display apparatus has characteristics of self-luminescence, small size, low power consumption, good display effect, no radiation and relatively low manufacturing cost. When the self-luminous display apparatus displays an image, a light-emitting control circuit in the self-luminous display apparatus supplies light-emitting control signals to pixel driving circuits in all rows of sub-pixel areas. The light-emitting control circuit includes a plurality of cascaded shift registers, and each shift register is configured to supply an enable signal for controlling a light-emitting device to emit light to pixel driving circuits in a row of sub-pixel areas, so that the display apparatus can display an image.

SUMMARY

In first aspect, a shift register is provided. The shift register includes an input sub-circuit, a control sub-circuit, an output sub-circuit and a reset sub-circuit. The input sub-circuit is electrically connected to an input signal terminal and a pull-up node. The input sub-circuit is configured to transmit an input signal from the input signal terminal to the pull-up node in response to the received input signal. The control sub-circuit is electrically connected to the pull-up node, a clock signal terminal and a control node. The control sub-circuit is configured to store a signal on the pull-up node, and to transmit a clock signal from the clock signal terminal to the control node in response to the signal received from the pull-up node. The output sub-circuit is electrically connected to the control node, a first voltage signal terminal, a second voltage signal terminal and a first output signal terminal. The output sub-circuit is configured to transmit a second voltage signal from the second voltage signal terminal to the first output signal terminal in response to the clock signal received from the control node, and to transmit a first voltage signal from the first voltage signal terminal to the first output signal terminal in response to the received first voltage signal. A reset sub-circuit is electrically connected to a first reset signal terminal, the control node, the pull-up node, the second voltage signal terminal and a third voltage signal terminal. The reset sub-circuit is configured to transmit the second voltage signal from the second voltage signal terminal to the control node to reset the control node, and to transmit a third voltage signal from the third voltage signal terminal to the pull-up node to reset the pull-up node, in response to a first reset signal received from the first reset signal terminal.

In some embodiments, the shift register further includes a denoising sub-circuit. The denoising sub-circuit is electrically connected to a fourth voltage signal terminal, the input signal terminal, the pull-up node, the second voltage signal terminal, the third voltage signal terminal and the control node. The denoising sub-circuit is configured to control a line between the control node and the second voltage signal terminal to be closed in response to a fourth voltage signal received from the fourth voltage signal terminal, so as to transmit the second voltage signal from the second voltage signal terminal to the control node, and to control the line between the control node and the second voltage signal terminal to be opened in response to the input signal received from the input signal terminal and the signal on the pull-up node and under a control of the third voltage signal from the third voltage signal terminal.

In some embodiments, the reset sub-circuit is further electrically connected to a second reset signal terminal. The reset sub-circuit is further configured to transmit the second voltage signal from the second voltage signal terminal to the control node to reset the control node, and/or to transmit the third voltage signal from the third voltage signal terminal to the pull-up node to reset the pull-up node, in response to a second reset signal received from the second reset signal terminal.

In some embodiments, the second voltage signal terminal is electrically connected to the third voltage signal terminal.

In some embodiments, the input sub-circuit includes a first transistor. A control electrode and a first electrode of the first transistor are electrically connected to the input signal terminal, and a second electrode of the first transistor is electrically connected to the pull-up node.

In some embodiments, the control sub-circuit includes a second transistor and a capacitor. A control electrode of the second transistor is electrically connected to the pull-up node, a first electrode of the second transistor is electrically connected to the clock signal terminal, and a second electrode of the second transistor is electrically connected to the control node. One terminal of the capacitor is electrically connected to the control electrode of the second transistor, and another terminal of the capacitor is electrically connected to the control node.

In some embodiments, the output sub-circuit includes a third transistor and a fourth transistor. A control electrode and a first electrode of the third transistor are electrically connected to the first voltage signal terminal, and a second electrode of the third transistor is electrically connected to the first output signal terminal and a second electrode of the fourth transistor. A control electrode of the fourth transistor is electrically connected to the control node, and a first electrode of the fourth transistor is electrically connected to the second voltage signal terminal.

In some embodiments, the reset sub-circuit includes a fifth transistor and a sixth transistor. A control electrode of the fifth transistor is electrically connected to the first reset signal terminal, a first electrode of the fifth transistor is electrically connected to the third voltage signal terminal, and a second electrode of the fifth transistor is electrically connected to the pull-up node. A control electrode of the sixth transistor is electrically connected to the first reset signal terminal, a first electrode of the sixth transistor is electrically connected to the second voltage signal terminal, and a second electrode of the sixth transistor is electrically connected to the control node.

In some embodiments, the reset sub-circuit includes a fifth transistor and a sixth transistor. A first electrode of the fifth transistor is electrically connected to the third voltage signal terminal, and a second electrode of the fifth transistor is electrically connected to the pull-up node. A first electrode of the sixth transistor is electrically connected to the second voltage signal terminal, and a second electrode of the sixth transistor is electrically connected to the control node. A control electrode of the fifth transistor is electrically connected to the first reset signal terminal, and a control electrode of the sixth transistor is electrically connected to the first reset signal terminal and the second reset signal terminal; or the control electrode of the fifth transistor is electrically connected to the first reset signal terminal and the second reset signal terminal, and the control electrode of the sixth transistor is electrically connected to the first reset signal terminal; or the control electrode of the fifth transistor is electrically connected to the first reset signal terminal and the second reset signal terminal, and the control electrode of the sixth transistor is electrically connected to the first reset signal terminal and the second reset signal terminal.

In some embodiments, the reset sub-circuit includes a fifth transistor, a sixth transistor and an eleventh transistor. A control electrode of the fifth transistor is electrically connected to the first reset signal terminal, a first electrode of the fifth transistor is electrically connected to the third voltage signal terminal, and a second electrode of the fifth transistor is electrically connected to the pull-up node. A control electrode of the sixth transistor is electrically connected to the first reset signal terminal, or the control electrode of the sixth transistor is electrically connected to the first reset signal terminal and the second reset signal terminal. A first electrode of the sixth transistor is electrically connected to the second voltage signal terminal, and a second electrode of the sixth transistor is electrically connected to the control node. A control electrode of the eleventh transistor is electrically connected to the second reset signal terminal, a first electrode of the eleventh transistor is electrically connected to the third voltage signal terminal, and a second electrode of the eleventh transistor is electrically connected to the pull-up node.

In some embodiments, the denoising sub-circuit includes a seventh transistor, an eighth transistor, a ninth transistor and a tenth transistor. A control electrode and a first electrode of the seventh transistor are electrically connected to the fourth voltage signal terminal, and a second electrode of the seventh transistor is electrically connected to a pull-down node. A control electrode of the eighth transistor is electrically connected to the input signal terminal, a first electrode of the eighth transistor is electrically connected to the third voltage signal terminal, and a second electrode of the eighth transistor is electrically connected to the pull-down node. A control electrode of the ninth transistor is electrically connected to the pull-up node, a first electrode of the ninth transistor is electrically connected to the third voltage signal terminal, and a second electrode of the ninth transistor is electrically connected to the pull-down node. A control electrode of the tenth transistor is electrically connected to the pull-down node, a first electrode of the tenth transistor is electrically connected to the second voltage signal terminal, and a second electrode of the tenth transistor is electrically connected to the control node.

In some embodiments, the shift register further includes a cascaded sub-circuit. The cascaded sub-circuit is electrically connected to the pull-up node, a pull-down node, the third voltage signal terminal, the clock signal terminal and a second output signal terminal. The cascaded sub-circuit is configured to transmit the clock signal from the clock signal terminal to the second output signal terminal in response to the signal received from the pull-up node, and to transmit the third voltage signal from the third voltage signal terminal to the second output signal terminal in response to a signal received from the pull-down node.

In some embodiments, the cascaded sub-circuit includes a twelfth transistor and a thirteenth transistor. A control electrode of the twelfth transistor is electrically connected to the pull-down node, a first electrode of the twelfth transistor is electrically connected to the third voltage signal terminal, and a second electrode of the twelfth transistor is electrically connected to the second output signal terminal. A control electrode of the thirteenth transistor is electrically connected to the pull-up node, a first electrode of the thirteenth transistor is electrically connected to the clock signal terminal, and a second electrode of the thirteenth transistor is electrically connected to the second output signal terminal.

In second aspect, a light-emitting control circuit is provided. The light-emitting control circuit includes M stages of cascaded shift registers according to any one of the above embodiments. M is an integer greater than 2. A control node of a first-stage shift register is electrically connected to an input signal terminal that is electrically connected to a second-stage shift register. A control node of an M-th-stage shift register is electrically connected to a first reset signal terminal that is electrically connected to an (M−1)-th-stage shift register. Except the first-stage shift register and the M-th-stage shift register, a control node of each stage shift register is electrically connected to a first reset signal terminal that is electrically connected to a previous-stage shift register and an input signal terminal that is electrically connected to a next-stage shift register.

In third aspect, a display apparatus is provided. The display apparatus includes at least one light-emitting control circuit according to the above embodiments.

In fourth aspect, another light-emitting control circuit is provided. The light-emitting control circuit includes M stages of cascaded shift registers according to any one of the above embodiments. M is an integer greater than 2. A second output signal terminal that is electrically connected to a first-stage shift register is electrically connected to an input signal terminal that is electrically connected to a second-stage shift register. A second output signal terminal that is electrically connected to an M-th-stage shift register is electrically connected to a first reset signal terminal that is electrically connected to an (M−1)-th-stage shift register. Except the first-stage shift register and the M-th-stage shift register, a second output signal terminal that is electrically connected to each stage shift register is electrically connected to a first reset signal terminal that is electrically connected to a previous-stage shift register and an input signal terminal that is electrically connected to a next-stage shift register.

In fifth aspect, another display apparatus is provided. The display apparatus includes at least one light-emitting control circuit according to the above embodiments.

In sixth aspect, a method for driving the shift register according to the above embodiments is provided. The method includes: in a first period of an image frame: transmitting, by the input sub-circuit, the input signal from the input signal terminal to the pull-up node in response to the received input signal; transmitting, by the control sub-circuit, the clock signal from the clock signal terminal to the control node in response to the signal received from the pull-up node; and transmitting, by the output sub-circuit, the first voltage signal from the first voltage signal terminal to the first output signal terminal in response to the received first voltage signal; in a second period of the image frame: transmitting, by the control sub-circuit, the clock signal from the clock signal terminal to the control node in response to the signal received from the pull-up node; and transmitting, by the output sub-circuit, the second voltage signal from the second voltage signal terminal to the first output signal terminal in response to the clock signal received from the control node; and in a third period of the image frame: transmitting, by the reset sub-circuit, the second voltage signal from the second voltage signal terminal to the control node to reset the control node in response to the first reset signal received from the first reset signal terminal; transmitting, by the reset sub-circuit, the third voltage signal from the third voltage signal terminal to the pull-up node to reset the pull-up node in response to the first reset signal received from the first reset signal terminal; and transmitting, by the output sub-circuit, the first voltage signal from the first voltage signal terminal to the first output signal terminal in response to the received first voltage signal.

In some embodiments, the reset sub-circuit is further electrically connected to a second reset signal terminal. The method further includes in a fourth period of the image frame: transmitting, by the reset sub-circuit, the second voltage signal from the second voltage signal terminal to the control node to reset the control node in response to a second reset signal received from the second reset signal terminal, and/or transmitting, by the reset sub-circuit, the third voltage signal from the third voltage signal terminal to the pull-up node to reset the pull-up node in response to the second reset signal received from the second reset signal terminal; and transmitting, by the output sub-circuit, the first voltage signal from the first voltage signal terminal to the first output signal terminal in response to the received first voltage signal.

In some embodiments, the shift register further includes a denoising sub-circuit. The denoising sub-circuit is electrically connected to a fourth voltage signal terminal, the input signal terminal, the pull-up node, the second voltage signal terminal, the third voltage signal terminal and the control node. The method further includes: in the first period of the image frame: controlling, by the denoising sub-circuit, a line between the control node and the second voltage signal terminal to be opened in response to the input signal received from the input signal terminal and the signal on the pull-up node and under a control of the third voltage signal from the third voltage signal terminal; in the second period of the image frame: controlling, by the denoising sub-circuit, the line between the control node and the second voltage signal terminal to be opened in response to the signal received from the pull-up node and under the control of the third voltage signal from the third voltage signal terminal; and in the third period of the image frame: controlling, by the denoising sub-circuit, the line between the control node and the second voltage signal terminal to be closed to transmit the second voltage signal from the second voltage signal terminal to the control node, in response to a fourth voltage signal received from the fourth voltage signal terminal.

BRIEF DESCRIPTION OF THE DRAWINGS

In order to describe technical solutions of the present disclosure more clearly, accompanying drawings to be used in some embodiments of the present disclosure will be introduced briefly. However, the accompanying drawings to be described below are merely accompanying drawings of some embodiments of the present disclosure, and a person of ordinary skill in the art can obtain other drawings according to these drawings. In addition, the accompanying drawings to be described below may be regarded as schematic diagrams, and are not limitations on actual dimensions of products, actual processes of methods and actual timings of signals to which the embodiments of the present disclosure relate.

DETAILED DESCRIPTION

Figure 1:
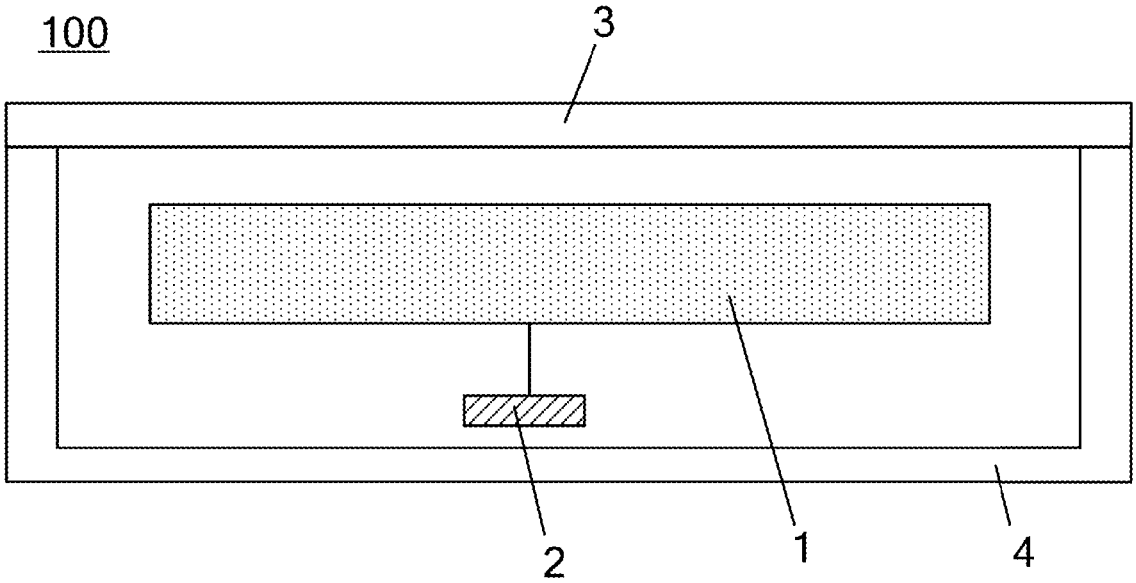
FIG. 1 is a structural diagram of a display apparatus, in accordance with some embodiments.

Technical solutions in some embodiments of the present disclosure will be described clearly and completely with reference to accompanying drawings. However, the described embodiments are merely some but not all of the embodiments of the present disclosure. All other embodiments obtained on a basis of embodiments of the present disclosure by a person of ordinary skill in the art shall be included in the protection scope of the present disclosure.

Unless the context requires otherwise, the term "comprise" and other forms thereof such as the third-person singular form "comprises" and the present participle form "comprising" in the description and the claims are construed as an open and inclusive, meaning "inclusive, but not limited to". In the description of the specification, terms such as "one embodiment", "some embodiments", "exemplary embodiments", "example", "specific example", or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Hereinafter, terms such as "first" and "second" are only used for descriptive purposes, and are not to be construed as indicating or implying the relative importance or implicitly indicating the number of indicated technical features. Thus, features defined as "first" and "second" may explicitly or implicitly include one or more of the features. As used in the specification and the claims, the singular forms "a", "an", and "the" may also include plural referents unless the content clearly dictates otherwise. In the description of the embodiments of the present disclosure, the term "a plurality of/the plurality of" means two or more unless otherwise specified.

In the description of some embodiments, terms such as "connected" and derivative expressions thereof may be used. For example, the term "connected" may be used in describing some embodiments to indicate that two or more components are in direct physical contact or electrical contact with each other. However, the term "connected" may also mean that two or more components are not in direct contact with each other but still cooperate or interact with each other. The embodiments disclosed herein are not necessarily limited to the content herein.

The expression "A and/or B" includes the following three combinations: only A, only B, and a combination of A and B.

Some embodiments of the present disclosure provide a self-luminous display apparatus, such as a mobile phone, a tablet computer, a personal digital assistance (PDA), a vehicle-mounted computer, or the like. Embodiments of the present disclosure impose no specific restriction on the type of the display apparatus.

FIG. 1 illustrates a structural diagram of the display apparatus 100 according to some embodiments. As shown in FIG. 1, the display apparatus 100 includes a display panel 1, a circuit board 2, a cover plate 3 and a frame 4.

A longitudinal section of the frame 4 may be, for example, U-shaped, and the display panel 1 and the circuit board 2 are located in a space surrounded by the frame 4.

The circuit board 2 is disposed at one side of the display panel 1, and the cover plate 3 is disposed at an opposite side of the display panel 1.

The circuit board 2 is configured to supply signals required for display to the display panel 1. The circuit board 2 may be, for example, a printed circuit board assembly (PCBA), and the PCBA includes a printed circuit board (PCB), and a timing controller (TCON), a power management integrated circuit (PMIC) and other ICs or circuits that are disposed on the PCB.

Figure 2:
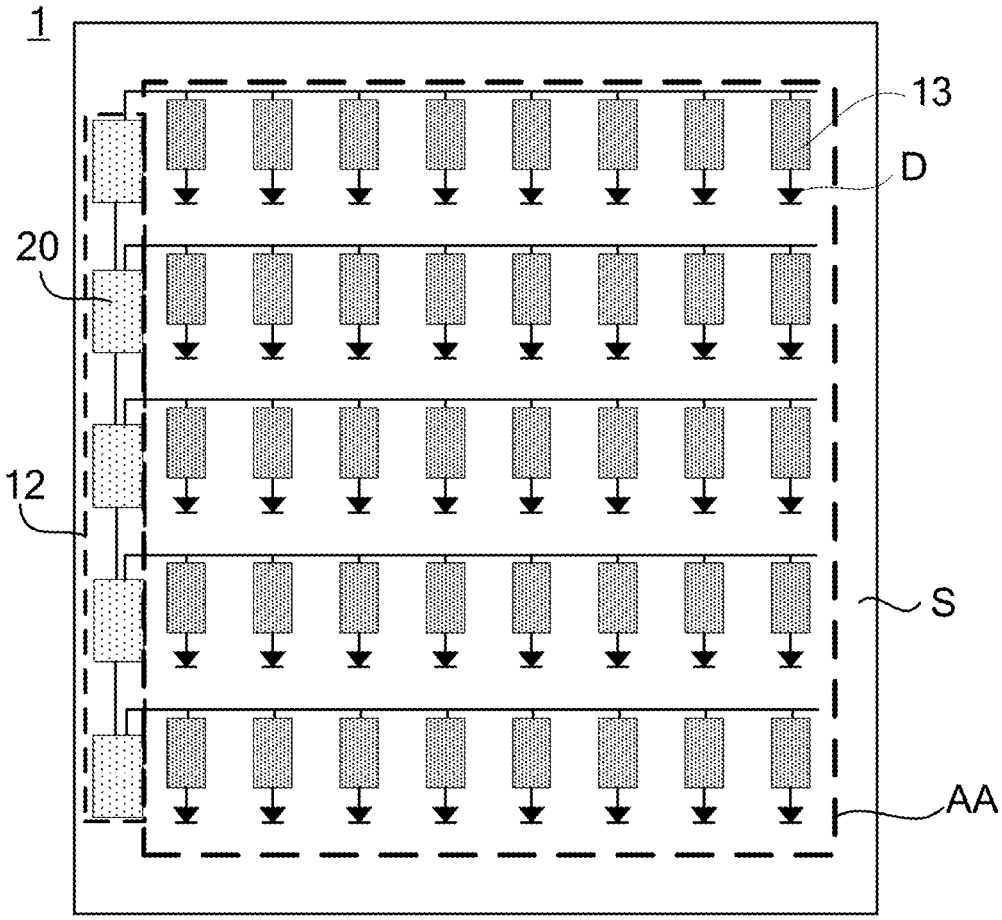
FIG. 2 is a structural diagram of a display panel, in accordance with some embodiments.

FIG. 2 illustrates a structural diagram of the display panel 1 in the display apparatus 100 according to some embodiments. As shown in FIG. 2, the display panel 1 has an active area (AA) and a peripheral area S. The peripheral area S may be, for example, located around the active area AA, or the peripheral area S may be located on only one side or two opposite sides of the active area AA.

In some embodiments, as shown in FIG. 2, the display panel 1 includes a plurality of pixel driving circuits 13 and a plurality of elements to be driven that are located in the active area AA. Each element to be driven is connected to one pixel driving circuit 13, and the element to be driven and the pixel driving circuit 13 connected thereto are located in a same sub-pixel area.

In some examples, the element to be driven is a current-driven light-emitting device D. For example, the light-emitting device D is a current-driven light-emitting diode, such as a micro light-emitting diode (Micro LED), a mini light-emitting diode (Mini LED), an organic light-emitting diode (OLED) or a quantum dot light-emitting diode (QLED).

The pixel driving circuit 13 includes a plurality of transistors (e.g., thin film transistors, TFTs) and at least one capacitor. In some examples, the pixel driving circuit 13 may have a "6T1C", "6T2C", or "7T1C" structure. Herein, "T" indicates a transistor, and the number before "T" indicates the number of the plurality of transistors in the pixel driving circuit 13. "C" indicates a capacitor, and the number before "C" indicates the number of the at least one capacitor in the pixel driving circuit 13. Of course, the pixel driving circuit 13 may also have another structure, which is not limited in the embodiments of the present disclosure.

Figure 3:
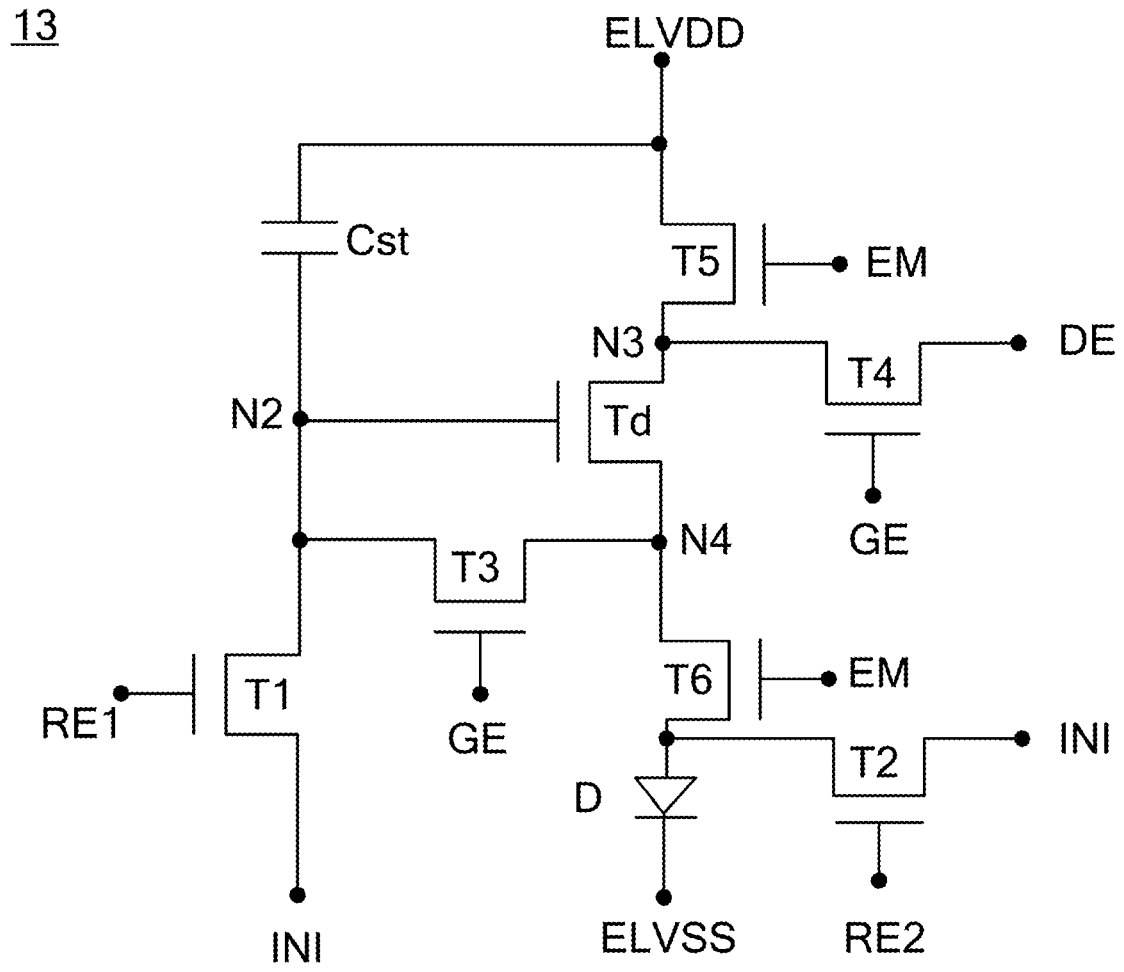
FIG. 3 is a structural diagram of a pixel driving circuit, in accordance with some embodiments.

FIG. 3 illustrates a structural diagram of the pixel driving circuit 13 in the display panel 1 according to some embodiments. As shown in FIG. 3, the pixel driving circuit 13 has the "7T1C" structure, which includes seven transistors and one capacitor, that is, a first switching transistor T1, a second switching transistor T2, a driving transistor Td, a third switching transistor T3, a fourth switching transistor T4, a fifth switching transistor T5, a sixth switching transistor T6 and a storage capacitor Cst.

A control electrode (i.e., gate) of the first switching transistor T1 is electrically connected to a first resetting signal terminal RE1, a first electrode of the first switching transistor T1 is electrically connected to an initialization signal terminal INI, and a second electrode of the first switching transistor T1 is electrically connected to a second node N2.

A control electrode (i.e., gate) of the second switching transistor T2 is electrically connected to a second resetting signal terminal RE2, a first electrode of the second switching transistor T2 is electrically connected to the initialization signal terminal INI, and a second electrode of the second switching transistor T2 is electrically connected to an anode of the light-emitting device D.

A control electrode (i.e., gate) of the driving transistor Td is electrically connected to the second node N2, a first electrode of the driving transistor Td is electrically connected to a third node N3, and a second electrode of the driving transistor Td is electrically connected to a fourth node N4. The driving transistor Td is configured to generate a driving current to drive the light-emitting device D to emit light. A width-to-length ratio of a channel of the driving transistor Td is greater than a width-to-length ratio of a channel of any switching transistor.

A control electrode (i.e., gate) of the third switching transistor T3 is electrically connected to a scanning signal terminal GE, a first electrode of the third switching transistor T3 is electrically connected to the fourth node N4, and a second electrode of the third switching transistor T3 is electrically connected to the second node N2.

A control electrode (i.e., gate) of the fourth switching transistor T4 is electrically connected to the scanning signal terminal GE, a first electrode of the fourth switching transistor T4 is electrically connected to a data signal terminal DE, and a second electrode of the fourth switching transistor T4 is electrically connected to the third node N3.

A control electrode (i.e., gate) of the fifth switching transistor T5 is electrically connected to an enable signal terminal EM, a first electrode of the fifth switching transistor T5 is electrically connected to a high voltage signal terminal ELVDD, and a second electrode of the fifth switching transistor T5 is electrically connected to the third node N3.

A control electrode (i.e., gate) of the sixth switching transistor T6 is electrically connected to the enable signal terminal EM, a first electrode of the sixth switching transistor T6 is electrically connected to the fourth node N4, and a second electrode of the sixth switching transistor T6 is electrically connected to the anode of the light-emitting device D.

One terminal of the storage capacitor Cst is electrically connected to the second node N2, and the other terminal of the storage capacitor Cst is electrically connected to the high voltage signal terminal ELVDD.

A cathode of the light-emitting device D is electrically connected to a low voltage signal terminal ELVSS. The low voltage signal terminal ELVSS may be, for example, a ground terminal.

Herein, a voltage value provided by the high voltage signal terminal ELVDD is greater than a voltage value provided by the low voltage signal terminal ELVSS.

For example, the initialization signal terminal INI is connected to an initialization signal line, the scanning signal terminal GE is connected to a gate line, the data signal terminal DE is connected to a data line, and the enable signal terminal EM is connected to an enable signal line. The high voltage signal terminal ELVDD is connected to a first voltage line, and the low voltage signal terminal ELVSS is connected to a second voltage line. The first resetting signal terminal RE1 is connected to one gate line, and the one gate line is a previous gate line adjacent to the gate line connected to the pixel driving circuit 13. The second resetting signal terminal RE2 is connected to another gate line, and the another gate line is a next gate line adjacent to the gate line connected to the pixel driving circuit 13.

In an image frame, a driving process of the pixel driving circuit 13 includes a first resetting period, a data writing period, a second resetting period and a light-emitting period.

In the first resetting period, the first switching transistor T1 is turned on in response to a first resetting signal received from the first resetting signal terminal RE1, and an initialization signal from the initialization signal terminal INI is transmitted to the second node N2 through the first switching transistor T1 to initialize the second node N2, thereby preventing an electrical signal remaining on the second node N2 in a previous image frame from affecting the current image frame.

In the data writing period, the fourth switching transistor T4 is turned on in response to a scanning signal received from the scanning signal terminal GE, and a data signal from the data signal terminal DE is transmitted to the third node N3 through the fourth switching transistor T4. The third switching transistor T3 is turned on in response to the scanning signal received from the scanning signal terminal GE, so that the second electrode of the driving transistor Td and the control electrode of the driving transistor Td are electrically connected to each other to form a diode structure. The data signal on the third node N3 is written to the second node N2 to compensate a threshold voltage of the driving transistor Td.

Here, in the data writing period, the data signal on the second node N2 charges the storage capacitor Cst, so that the driving transistor Td is kept turned on by the stored electric energy of the storage capacitor Cst in a case where the third switching transistor T3 and the fourth switching transistor T4 are turned off after the data writing period. In the data writing period, the fifth switching transistor T5 and the sixth switching transistor T6 are in an off state, and the high voltage signal terminal ELVDD, the light-emitting device D and the low voltage signal terminal ELVSS are disconnected. Therefore, the light-emitting device D does not emit light in this period.

In the second resetting period, the second switching transistor T2 is turned on in response to a second resetting signal received from the second resetting signal terminal RE2, the initialization signal from the initialization signal terminal INI is transmitted to the anode of the light-emitting device D through the second switching transistor T2 to initialize the anode of the light-emitting device D, thereby preventing an electrical signal remaining on the anode of the light-emitting device D in the previous frame from affecting the current image frame.

In the light-emitting period, the fifth switching transistor T5 and the sixth switching transistor T6 are turned on in response to an enable signal received from the enable signal terminal EM, a voltage signal from the high voltage signal terminal ELVDD is transmitted to the first electrode of the driving transistor Td through the fifth switching transistor T5. Since the second electrode of the driving electrode Td is electrically connected to the anode of the light-emitting device D, the driving transistor Td can output a driving current according to a data signal on the control electrode thereof and a voltage signal on the first electrode thereof, so as to drive the light-emitting device D to emit light.

In some embodiments, as shown in FIG. 2, the display panel 1 further includes a light-emitting control circuit 12 located in the peripheral area S. The light-emitting control circuit 12 may be, for example, connected to all enable signal lines and provides an enable signal to each enable signal line, so that the enable signal is transmitted to the enable signal terminal EM.

For example, the light-emitting control circuit 12 is located in a region of the peripheral area S located on a side of the active area AA. For another example, the light-emitting control circuit 12 is located in regions of the peripheral area S located on two opposite sides of the active area AA.

In some other embodiments, the display panel 1 includes two light-emitting control circuits 12 located in the peripheral area S. Each light-emitting control circuit 12 may be, for example, connected to all the enable signal lines and provides an enable signal to each enable signal line, so that the enable signal is transmitted to the enable signal terminal EM.

For example, one of the two light-emitting control circuits 12 is located in a region of the peripheral area S located on a side of the active area AA, and the other of the two light-emitting control circuits 12 is located in a region of the peripheral area S located on the opposite side of the active area AA.

Figure 4A:
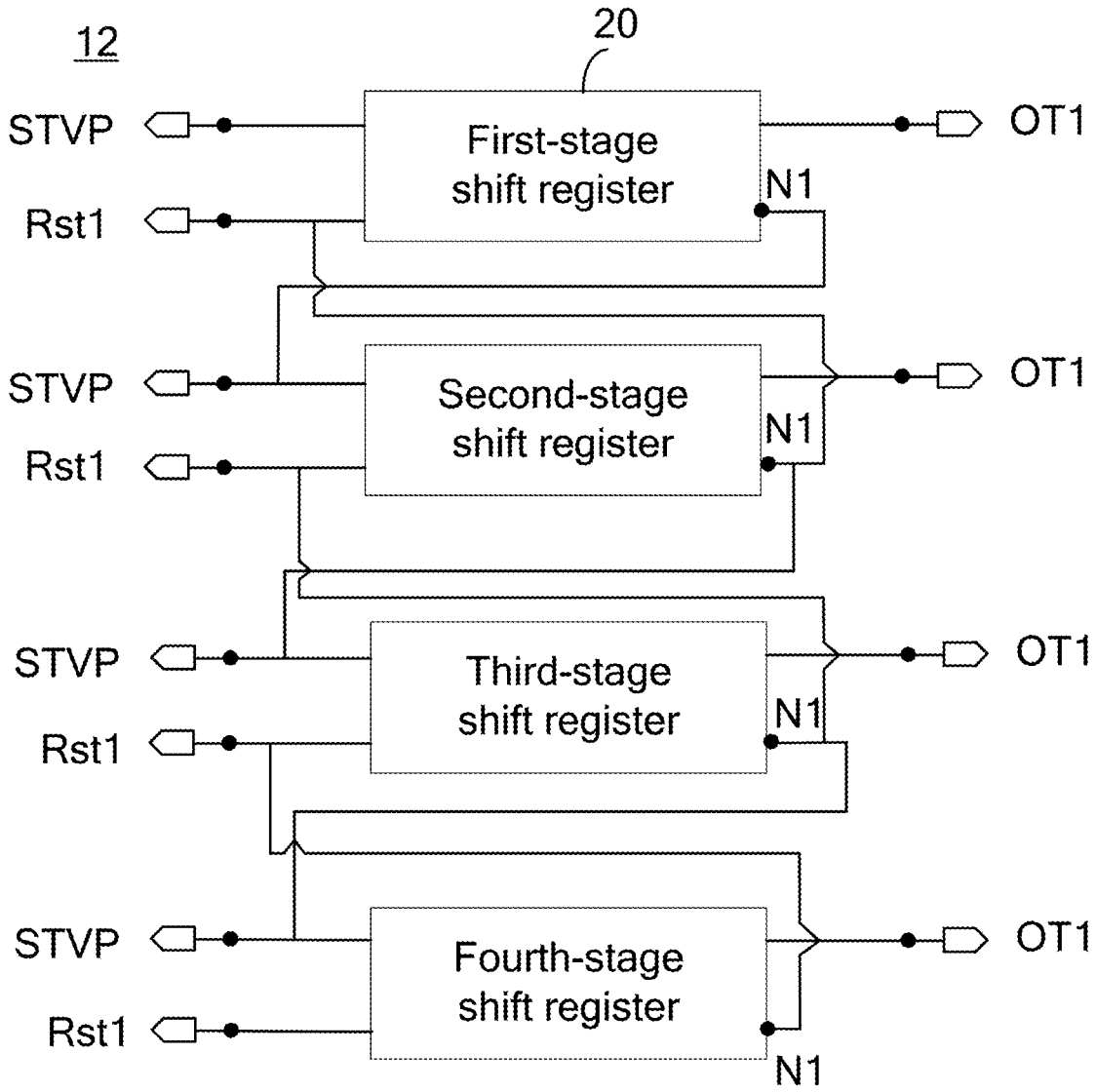
FIG. 4A is a structural diagram of a light-emitting control circuit, in accordance with some embodiments.
Figure 4B:
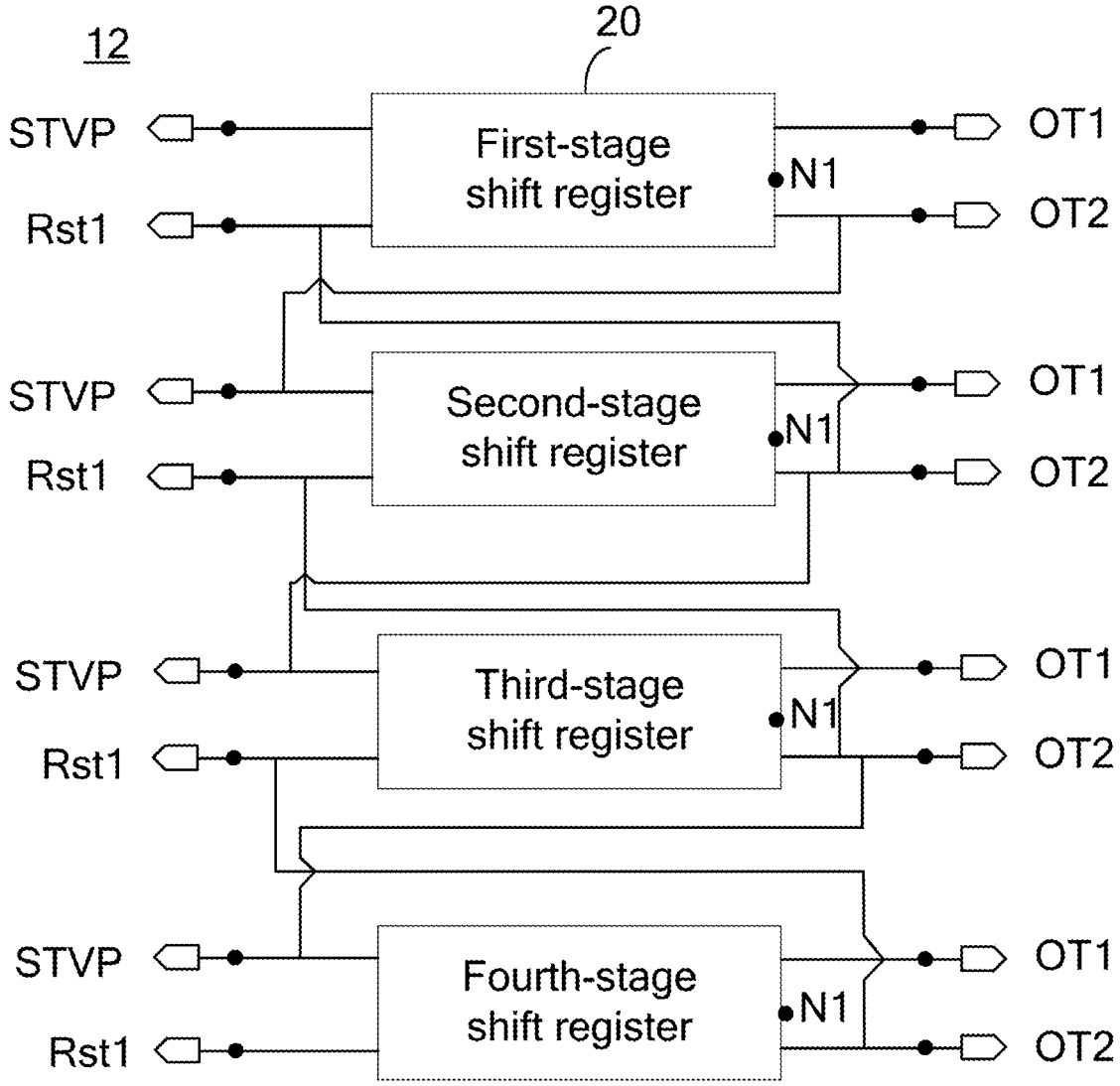
FIG. 4B is a structural diagram of another light-emitting control circuit, in accordance with some embodiments.
Figure 4C:
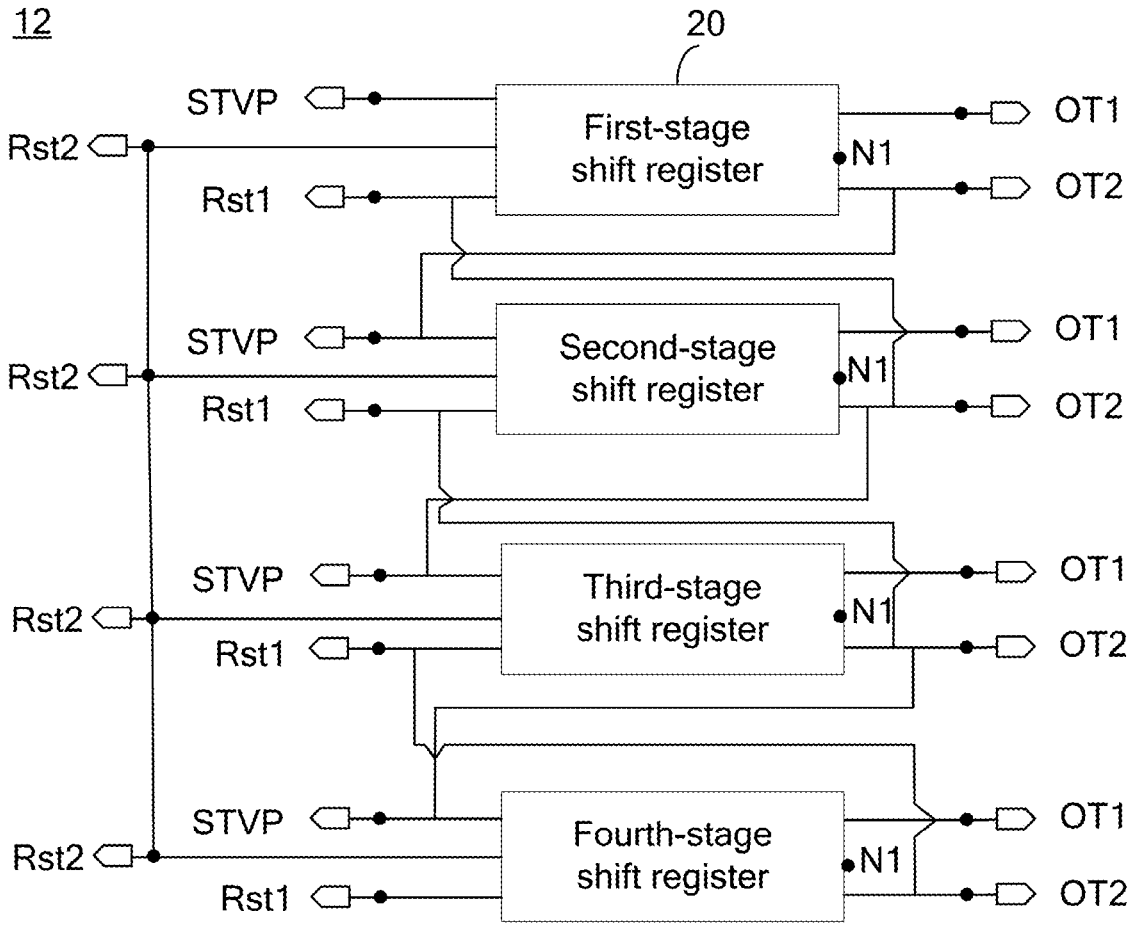
FIG. 4C is a structural diagram of yet another light-emitting control circuit, in accordance with some embodiments.

FIGS. 4A to 4C illustrate a structural diagram of the light-emitting control circuit 12 in the display panel 1 according to some embodiments. As shown in FIGS. 4A to 4C, the light-emitting control circuit 12 includes a plurality of cascaded shift registers 20. Each shift register 20 is electrically connected to all pixel driving circuits 13 located in one row of sub-pixel areas. For example, each shift register 20 is electrically connected to an enable signal line that is electrically connected to all the pixel driving circuits 13 located in the row of sub-pixel areas, and the shift register 20 is configured to output an enable signal to the enable signal line electrically connected thereto.

FIGS. 5A to 5E, 7A to 7C, 9A and 9B, and 11A to 11F illustrate a structural diagram of the shift register 20 in the light-emitting control circuit 12 according to some embodiments.

As shown in FIGS. 5A to 5E, 7A to 7C, 9A and 9, and 11A to 11F, the shift register 20 includes an input sub-circuit 200, a control sub-circuit 201, an output sub-circuit 202 and a reset sub-circuit 203.

The input sub-circuit 200 is electrically connected to an input signal terminal STVP and a pull-up node PU. The input signal terminal STVP is configured to receive an input signal and transmit the input signal to the input sub-circuit 200. The input sub-circuit 200 is configured to transmit the input signal from the input signal terminal STVP to the pull-up node PU in response to the received input signal.

The control sub-circuit 201 is electrically connected to the pull-up node PU, a clock signal terminal CK and a control node N1. The clock signal terminal CK is configured to receive a clock signal and transmit the clock signal to the control sub-circuit 201. The clock signal has a first voltage and a second voltage, one of the first voltage and the second voltage is a low voltage, and the other of the first voltage and the second voltage is a high voltage. That is, the clock signal has different voltages at different periods. The control sub-circuit 201 is configured to store a signal on the pull-up node PU, and to transmit the clock signal from the clock signal terminal CK to the first node N1 in response to the signal received from the pull-up node PU.

It will be noted that in order to facilitate the description and distinguish the control node N1 in the light-emitting control circuit 12 from the nodes in the pixel driving circuit 13 described above, the control node N1 is referred to as a first node N1 in the following embodiments.

For example, in a case where the light-emitting control circuit 12 is electrically connected to the timing controller TCON, the clock signal terminal CK may be electrically connected to the timing controller TCON to receive the clock signal provided by the timing controller TCON.

The output sub-circuit 202 is electrically connected to the first node N1, a first voltage signal terminal VDD1, a second voltage signal terminal VGL and a first output signal terminal OT1. The first voltage signal terminal VDD1 is configured to receive a first voltage signal and transmit the first voltage signal to the output sub-circuit 202. The second voltage signal terminal VGL is configured to receive a second voltage signal and transmit the second voltage signal to the output sub-circuit 202.

The output sub-circuit 202 is configured to transmit the second voltage signal from the second voltage signal terminal VGL to the first output signal terminal OT1 in response to the first voltage of the clock signal received from the first node N1, and to transmit the first voltage signal from the first voltage signal terminal VDD1 to the first output signal terminal OT1 in response to the received first voltage signal.

Herein, the first output signal terminal OT1 outputs the first voltage signal and the second voltage signal in different periods of one image frame, and the first voltage signal and the second voltage signal constitute the enable signal.

It will be noted that the first voltage signal and the second voltage signal are different voltage signals. For example, in a case where the first voltage signal is a high voltage signal, the second voltage signal is a low voltage signal. Herein, "high" and "low" are relative concepts. Only the first voltage signal and the second voltage signal are compared, the one with a high voltage is referred to as a high voltage signal, and the one with a low voltage is referred to as a low voltage signal.

In an example where in the pixel driving circuit 13 shown in FIG. 3, the first output signal terminal OT1 is electrically connected to the enable signal line that is connected to all the pixel driving circuits 13 located in one row of sub-pixel areas, in a case where the fifth switching transistor T5 and the sixth switching transistor T6 in the pixel driving circuit 13 are N-type transistors, the fifth switching transistor T5 and the sixth switching transistor T6 are turned on and the light-emitting device D emits light in a period when the first voltage signal with a high voltage is transmitted from the first output signal terminal OT1; the fifth switching transistor T5 and the sixth switching transistor T6 are turned off in a period when the second voltage signal with a low voltage is transmitted from the first output signal terminal OT1, and period the first resetting period, the data writing period and the second resetting period may be in this period.

Figure 5A:
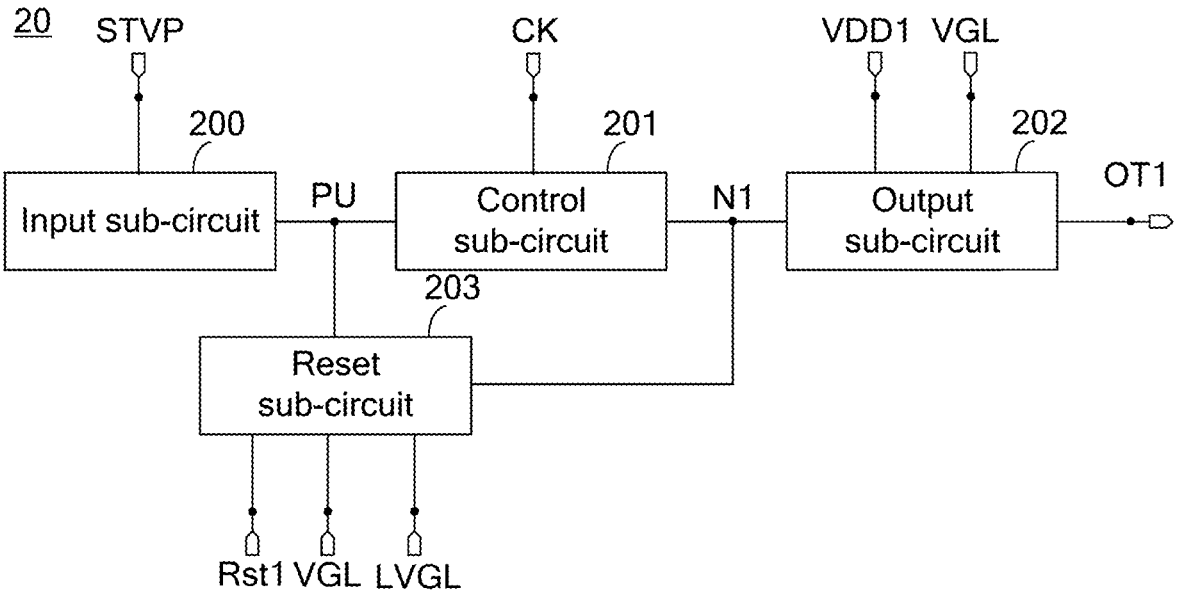
FIG. 5A is a structural diagram of a shift register, in accordance with some embodiments.

As shown in FIG. 5A, the reset sub-circuit 203 is electrically connected to a first reset signal terminal Rst1, the first node N1, the pull-up node PU, the second voltage signal terminal VGL and a third voltage signal terminal LVGL. The first reset signal terminal Rst1 is configured to receive a first reset signal and transmit the first reset signal to the reset sub-circuit 203. The third voltage signal terminal LVGL is configured to receive a third voltage signal and transmit the third voltage signal to the reset sub-circuit 203.

The reset sub-circuit 203 is configured to transmit the second voltage signal from the second voltage signal terminal VGL to the first node N1 to reset the first node N1, and to transmit the third voltage signal from the third voltage signal terminal LVGL to the pull-up node PU to reset the pull-up node PU, in response to the first reset signal received from the first reset signal terminal Rst1.

In some examples, the second voltage signal terminal VGL is electrically connected to the third voltage signal terminal LVGL. That is, the second voltage signal and the third voltage signal are the same voltage signal (e.g., a direct current (DC) low voltage signal). In this way, the number of signal lines in the shift register 20 may be reduced, and the difficulty in circuit connections and wiring are reduced.

Of course, the second voltage signal and the third voltage signal may also be different signals as long as the first node N1 and the pull-up node PU can be reset through the second voltage signal and the third voltage signal, respectively.

In the shift register 20 provided by some embodiments of the present disclosure, in different periods of the image frame, the output sub-circuit 202 outputs the second voltage signal from the second voltage signal terminal VGL under the control of the first voltage of the clock signal from the first node N1, and outputs the first voltage signal from the first voltage signal terminal VDD1 under the control of the first voltage signal. The first voltage signal and the second voltage signal constitute the enable signal and are input to the pixel driving circuit 13, so that the pixel driving circuit 13 drives the light-emitting device D to emit light. In this way, the shift register 20 has a simple structure and a low manufacturing cost.

Figure 5B:
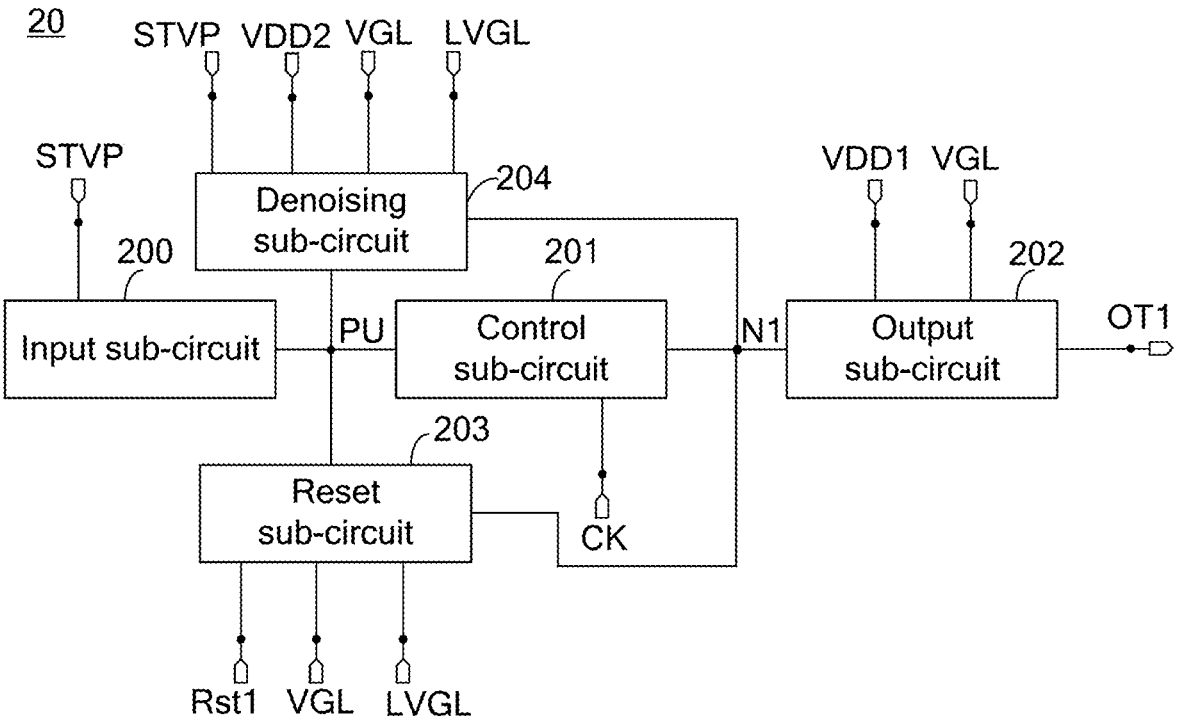
FIG. 5B is a structural diagram of another shift register, in accordance with some embodiments.
Figure 5C:
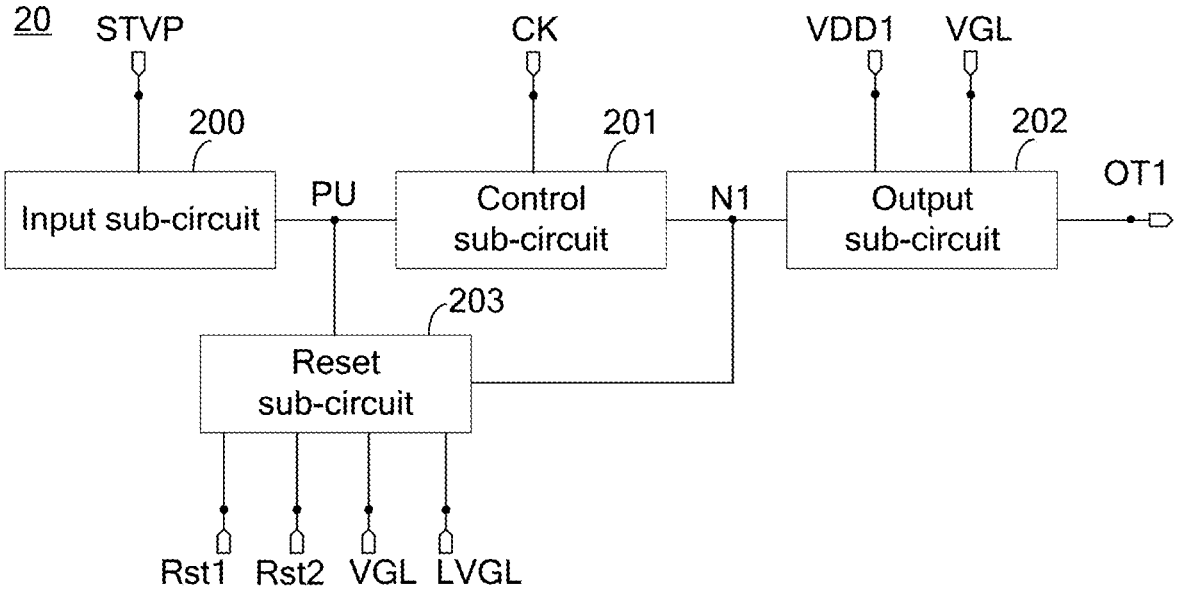
FIG. 5C is a structural diagram of yet another shift register, in accordance with some embodiments.
Figure 5D:
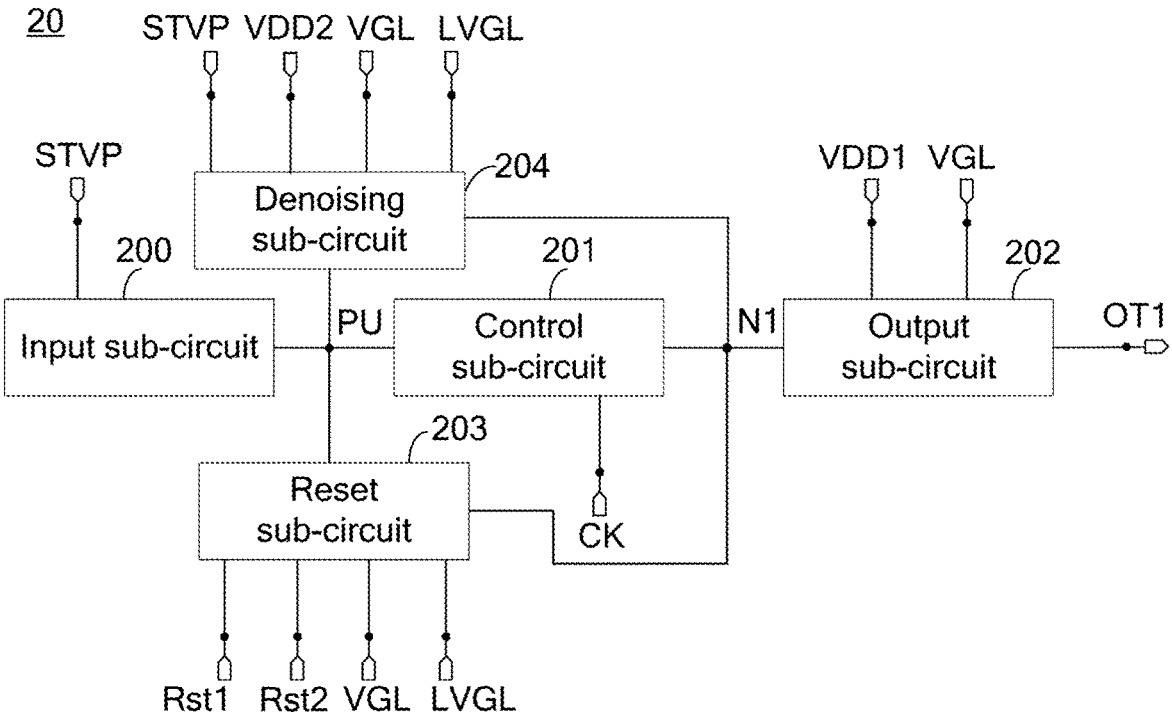
FIG. 5D is a structural diagram of yet another shift register, in accordance with some embodiments.

In some embodiments, as shown in FIGS. 5C and 5D, the reset sub-circuit 203 is further electrically connected to a second reset signal terminal Rst2. The second reset signal terminal Rst2 is configured to receive a second reset signal and transmit the second reset signal to the reset sub-circuit 203.

In this case, the reset sub-circuit 203 is further configured to transmit the second voltage signal from the second voltage signal terminal VGL to the first node N1 to reset the first node N1, in response to the second reset signal received from the second reset signal terminal Rst2, and/or, to transmit the third voltage signal from the third voltage signal terminal LVGL to the pull-up node PU to reset the pull-up node PU, in response to the second reset signal received from the second reset signal terminal Rst2.

In this way, before a next image frame starts, the first node N1 and/or the pull-up node PU can be reset through the second reset signal in preparation for the normal display of the next image frame.

In some embodiments, as shown in FIGS. 5B and 5D, the shift register 20 further includes a denoising sub-circuit 204. The denoising sub-circuit 204 is electrically connected to a fourth voltage signal terminal VDD2, the input signal terminal STVP, the pull-up node PU, the second voltage signal terminal VGL, the third voltage signal terminal LVGL and the first node N1. The fourth voltage signal terminal VDD2 is configured to receive a fourth voltage signal and transmit the fourth voltage signal to the denoising sub-circuit 204.

In some examples, the first voltage signal terminal VDD1 and the fourth voltage signal terminal VDD2 that are electrically connected to the shift register 20 are a same signal terminal as the high voltage signal terminal ELVDD electrically connected to the pixel driving circuit 13. In this way, it is possible to reduce the number of wirings in the display panel 1 and simplify the production process. In this case, the first voltage signal, the fourth voltage signal and the voltage signal from the high voltage signal terminal ELVDD are the same voltage signal (e.g., a DC high voltage signal).

The denoising sub-circuit 204 is configured to control a line between the first node N1 and the second voltage signal terminal VGL to be closed in response to the fourth voltage signal received from the fourth voltage signal terminal VDD2, so as to transmit the second voltage signal from the second voltage signal terminal VGL to the first node N1, and to control the line between the first node N1 and the second voltage signal terminal VGL to be opened, in response to the input signal received from the input signal terminal STVP and the signal on the pull-up node PU and under the control of the third voltage signal from the third voltage signal terminal LVGL. The denoising sub-circuit 204 disconnects an electrical connection between the first node N1 and the second voltage signal terminal VGL, that is, the second voltage signal from the second voltage signal terminal VGL cannot be transmitted to the first node N1.

On the one hand, the denoising sub-circuit 204 can disconnect the electrical connection between the first node N1 and the second voltage signal terminal VGL in a period when the second voltage signal from the second voltage signal terminal VGL is transmitted from the first output signal terminal OT1, so that the first voltage of the clock signal on the first node N1 controls the output sub-circuit 202 to output the second voltage signal; on another hand, the denoising sub-circuit 204 can pull the voltage on the first node N1 to a voltage of the second voltage signal in a period when the first voltage signal from the first voltage signal terminal VDD1 is transmitted from the first output signal terminal OT1, so as to ensure that the output sub-circuit 202 only outputs the first voltage signal. Therefore, the denoising sub-circuit 204 can ensure accuracy of the enable signal output by the first output signal terminal OT1.

Figure 5E:
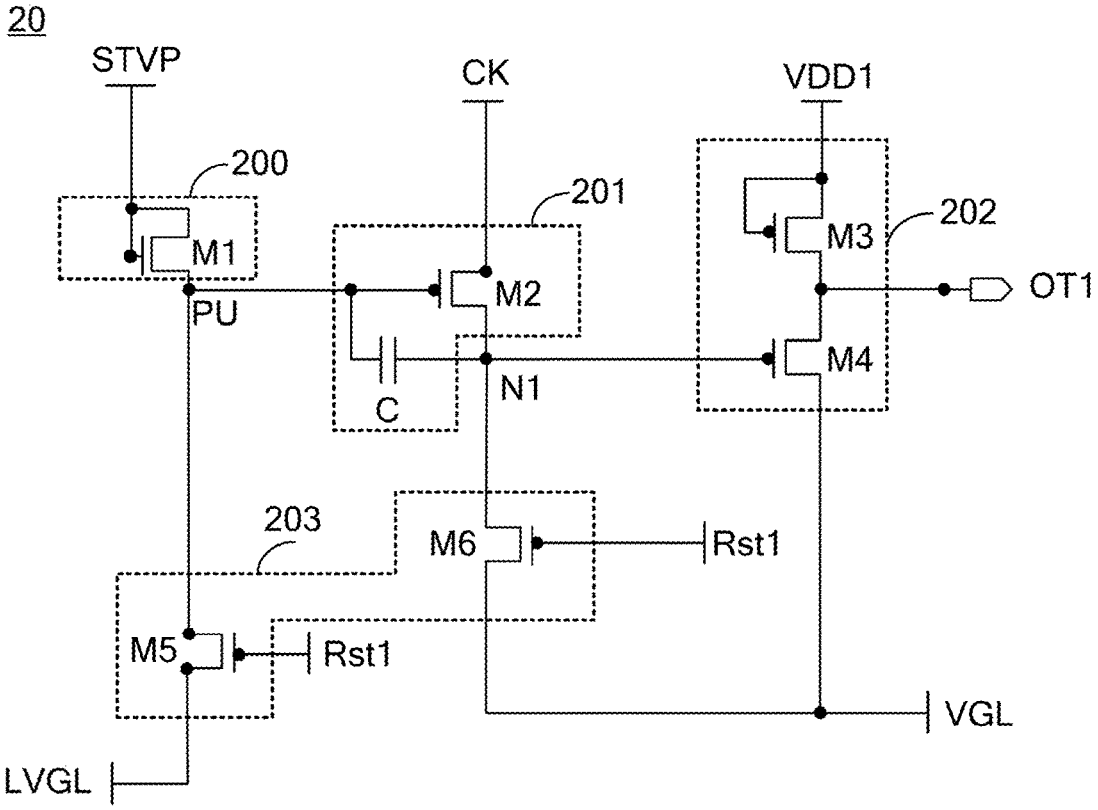
FIG. 5E is a structural diagram of yet another shift register, in accordance with some embodiments.

In some embodiments, as shown in FIG. 5E, the input sub-circuit 200 includes a first transistor M1.

A control electrode (i.e., gate) and a first electrode of the first transistor M1 are electrically connected to the input signal terminal STVP, and a second electrode of the first transistor M1 is electrically connected to the pull-up node PU. The first transistor M1 is configured to be turned on in response to the input signal received from the input signal terminal STVP to transmit the input signal to the pull-up node PU.

In some examples, the input sub-circuit 200 includes a plurality of first transistors M1 connected in parallel. The above is merely an example of the input sub-circuit 200, and other structures with a same function as the input sub-circuit 200 will not be repeated herein, but shall all be included in the protection scope of the present disclosure.

In some embodiments, as shown in FIG. 5E, the control sub-circuit 201 includes a second transistor M2 and a capacitor C.

A control electrode (i.e., gate) of the second transistor M2 is electrically connected to the pull-up node PU, a first electrode of the second transistor M2 is electrically connected to the clock signal terminal CK, and a second electrode of the second transistor M2 is electrically connected to the first node N1. The second transistor M2 is configured to be turned on in response to the signal received from the pull-up node PU, and to transmit the clock signal from the clock signal terminal CK to the first node N1.

One terminal of the capacitor C is electrically connected to the control electrode of the second transistor M2, and the other terminal of the capacitor C is electrically connected to the first node N1. The capacitor C is configured to store the signal on the pull-up node PU to maintain a voltage on the control electrode of the second transistor M2.

In some examples, the control sub-circuit 201 includes a plurality of capacitors C connected in parallel and a plurality of second transistors M2 connected in parallel. The above is merely an example of the control sub-circuit 201, and other structures with the same function as the control sub-circuit 201 will not be repeated herein, but shall all be included in the protection scope of the present disclosure.

In some embodiments, as shown in FIG. 5E, the output sub-circuit 202 includes a third transistor M3 and a fourth transistor M4.

A control electrode (i.e., gate) and a first electrode of the third transistor M3 are electrically connected to the first voltage signal terminal VDD1, and a second electrode of the third transistor M3 is electrically connected to the first output signal terminal OT1 and a second electrode of the fourth transistor M4. The third transistor M3 is configured to be turned on in response to the first voltage signal received from the first voltage signal terminal VDD1 to transmit the first voltage signal to the first output signal terminal OT1.

A control electrode (i.e., gate) of the fourth transistor M4 is electrically connected to the first node N1, and a first electrode of the fourth transistor M4 is electrically connected to the second voltage signal terminal VGL. The fourth transistor M4 is configured to be turned on in response to the first voltage of the clock signal received from the first node N1 to transmit the second voltage signal from the second voltage signal terminal VGL to the first output signal terminal OT1.

For example, a width-to-length ratio of a channel of the fourth transistor M4 is greater than a width-to-length ratio of a channel of the third transistor M3.

If the third transistor M3 is kept to be turned on, the third transistor M3 outputs the first voltage signal to the first output signal terminal OT1 when the fourth transistor M4 is turned on to output the second voltage signal to the first output signal terminal OT1. Since the width-to-length ratio of the channel of the fourth transistor M4 is greater than the width-to-length ratio of the channel of the third transistor M3, that is, a driving capability of the fourth transistor M4 is greater than a driving capability of the third transistor M3, the first output signal on the first output signal terminal OT1 can be pulled to be close to or even equal to the second voltage signal in a case where both the third transistor M3 and the fourth transistor M4 are turned on.

In some examples, the output sub-circuit 202 includes a plurality of third transistors M3 connected in parallel and a plurality of fourth transistors M4 connected in parallel. The above is merely an example of the output sub-circuit 202, and other structures with a same function as the output sub-circuit 202 will not be repeated herein, but shall all be included in the protection scope of the present disclosure.

In some embodiments, as shown in FIG. 5E, the reset sub-circuit 203 includes a fifth transistor M5 and a sixth transistor M6.

A control electrode (i.e., gate) of the fifth transistor M5 is electrically connected to the first reset signal terminal Rst1, a first electrode of the fifth transistor M5 is electrically connected to the third voltage signal terminal LVGL, and a second electrode of the fifth transistor M5 is electrically connected to the pull-up node PU. The fifth transistor M5 is configured to be turned on in response to the first reset signal received from the first reset signal terminal Rst1 to transmit the third voltage signal from the third voltage signal terminal LVGL to the pull-up node PU to reset the pull-up node PU.

A control electrode (i.e., gate) of the sixth transistor M6 is electrically connected to the first reset signal terminal Rst1, a first electrode of the sixth transistor M6 is electrically connected to the second voltage signal terminal VGL, and a second electrode of the sixth transistor M6 is electrically connected to the first node N1. The sixth transistor M6 is configured to be turned on in response to the first reset signal received from the first reset signal terminal Rst1 to transmit the second voltage signal from the second voltage signal terminal VGL to the first node N1 to reset the first node N1.

In some examples, the reset sub-circuit 203 includes a plurality of fifth transistors M5 connected in parallel and a plurality of sixth transistors M6 connected in parallel. The above is merely an example of the reset sub-circuit 203, and other structures with a same function as the reset sub-circuit 203 will not be repeated herein, but shall all be included in the protection scope of the present disclosure.

In some embodiments, all transistors in the shift register 20 are transistors with a same type, such as N-type. In this case, in each transistor, a first electrode may be a drain and a second electrode may be a source. It will be noted that since the source and drain of the transistor are symmetrical in structure, the source and drain of the transistor may be structurally indistinguishable. That is, in some other embodiments, in the transistor, the first electrode may be a source and the second electrode may be a drain.

For example, the N-type transistor is a N-type metal oxide semiconductor field effect transistor (NMOS transistor). For example, a material of an active layer of each transistor in the shift register 20 is a metal oxide, such as indium gallium zinc oxide (IGZO), indium neodymium oxide (InNdO), or the like. The active layer made of the metal oxide may be manufactured by a low temperature polycrystalline oxide (LTPO) process.

The transistor with the active layer made of the metal oxide has a smaller leakage current and lower power consumption than a transistor with an active layer made of a polysilicon (p-si). The N-type transistors may be manufactured by the LTPO process, which not only makes power consumption and production cost of the shift register 20 low, but also generates the enable signal that meets the pixel driving circuit 13.

Figure 6:
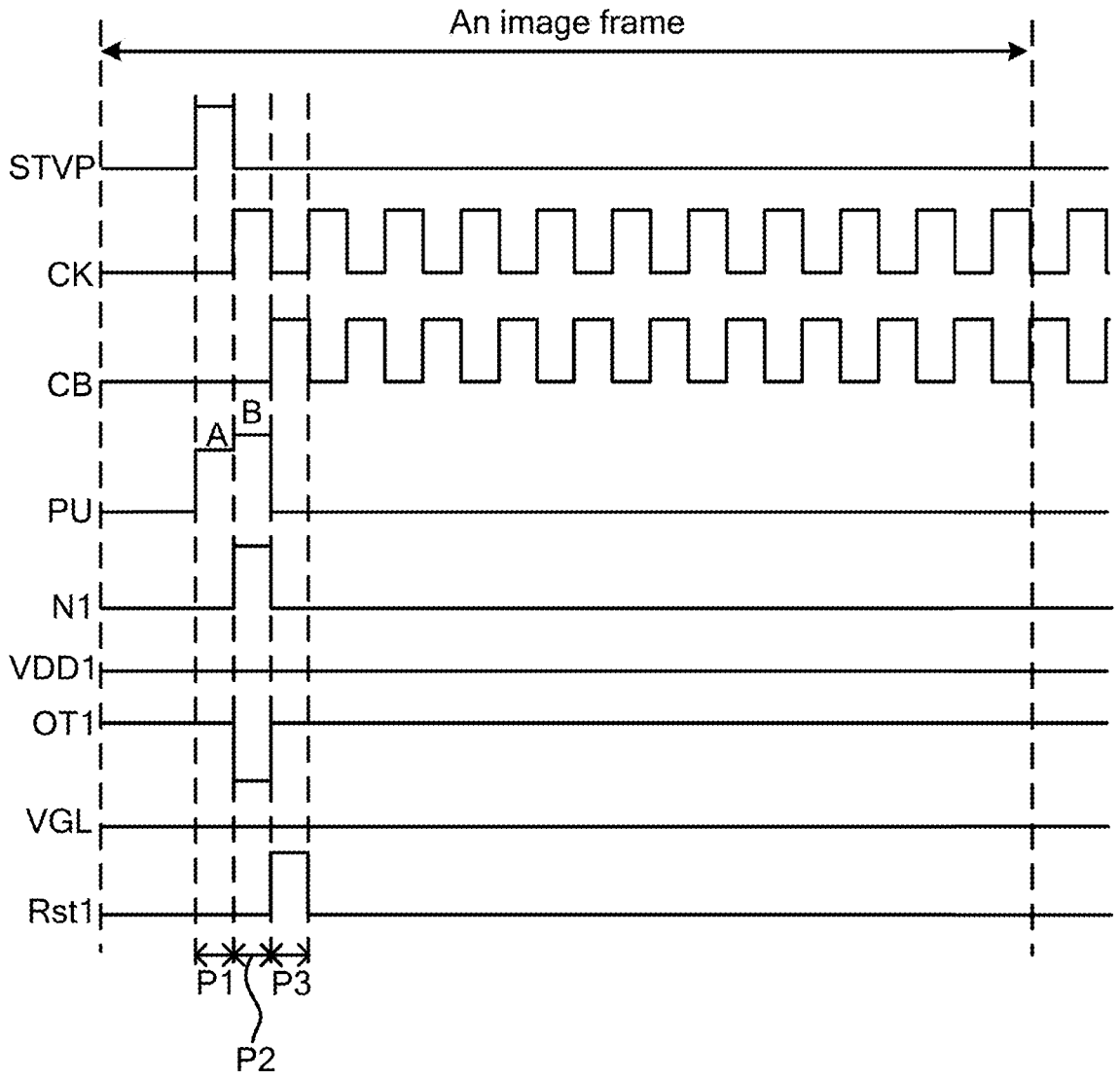
FIG. 6 is a timing diagram of a shift register, in accordance with some embodiments.

FIG. 6 illustrates a timing diagram of the shift register 20 according to some embodiments. Hereinafter, in an example where the first transistor to the sixth transistor are all N-type transistors in the shift register 20 shown in FIG. 5E, a working process of the shift register 20 in the image frame is exemplarily illustrated with reference to FIG. 6. In the image frame, the working process of the shift register 20 includes a first period P1, a second period P2 and a third period P3.

In the first period P1, a voltage of the input signal from the input signal terminal STVP is a high voltage, a voltage of the clock signal from the clock signal terminal CK is the second voltage, and the second voltage is a low voltage.

The first transistor M1 is turned on in response to the high voltage of the input signal received from the input signal terminal STVP, and the high voltage of the input signal is transmitted to the pull-up node PU through the first transistor M1, so that a potential on the pull-up node PU rises to a first potential A. The capacitor C stores the first potential A.

The second transistor M2 is turned on in response to the first potential A on the pull-up node PU, and the second voltage from the clock signal terminal CK is transmitted to the first node N1 through the second transistor M2. In this case, a potential on the first node N1 is a low potential, and thus the fourth transistor M4 is turned off.

The third transistor M3 is turned on in response to the first voltage signal received from the first voltage signal terminal VDD1, and the first voltage signal is transmitted to the first output signal terminal OT1 through the third transistor M3, so that the first output signal terminal OT1 outputs the first voltage signal.

In the second period P2, the voltage of the input signal from the input signal terminal STVP is a low voltage, the voltage of the clock signal from the clock signal terminal CK is the first voltage, and the first voltage is a high voltage.

Since the voltage of the input signal from the input signal terminal STVP is a low voltage, the first transistor M1 is turned off, so that the pull-up node PU is floating. Due to a storage effect of the capacitor C, the second transistor M2 remains on, the first voltage from the clock signal terminal CK is transmitted to the first node N1 through the second transistor M2, and the potential of the first node N1 is changed from a low potential to a high potential. Due to a bootstrap effect of the capacitor C, a potential of the pull-up node PU is increased to a second potential B when the potential of the first node N1 is changed from a low potential to a high potential. The potential of the pull-up node PU is increased to the second potential B, increasing a potential difference between the control electrode and the source of the second transistor M2, which may improve the output capability and working performance of the second transistor M2.

The fourth transistor M4 is turned on in response to the high potential received from the first node N1, and the second voltage signal from the second voltage signal terminal VGL is transmitted to the first output signal terminal OT1 through the fourth transistor M4, so that the first output signal terminal OT1 outputs the second voltage signal.

The second period P2 may be, for example, in a same period as the first resetting period, the data writing period and the second resetting period of the driving process of the pixel driving circuit 13. The pixel driving circuit 13 shown in FIG. 3 is taken as an example. In the second period P2, the enable signal transmitted from the first output signal terminal OT1 to the enable signal line electrically connected thereto is a low voltage, and thus the fifth switching transistor T5 and the sixth switching transistor T6 electrically connected to the enable signal line are turned off, so that the second node N2 and the anode of the light-emitting device D can be initialized, the threshold voltage of the driving transistor Td can be compensated, and then the data signal can be written to the second node N2.

In the third period P3, the voltage of the input signal from the input signal terminal STVP is a low voltage, the voltage of the clock signal from the clock signal terminal CK is a low voltage, and the voltage of the first reset signal from the first reset signal terminal Rst1 is a high voltage.

The fifth transistor M5 and the sixth transistor M6 are turned on in response to the high voltage received from the first reset signal terminal Rst1. As a result, the third voltage signal from the third voltage signal terminal LVGL is transmitted to the pull-up node PU through the fifth transistor M5 to reset the pull-up node PU, and the second voltage signal from the second voltage signal terminal VGL is transmitted to the first node N1 through the sixth transistor M6 to reset the first node N1.

Since the capacitor C has a function of maintaining the potential of the first node N1 and the potential of the pull-up node PU, it is necessary to discharge the pull-up node PU and the first node N1 through the reset sub-circuit 203 to avoid a problem that in the third period P3, due to an action of the potential of the first node N1, the fourth transistor M4 remains on to output the second voltage signal to the first output signal terminal OT1, which affects the first output signal terminal OT1 transmitting the first voltage signal.

It will be noted that, when the pixel driving circuit 13 is driven, a clock signal required by pixel driving circuits 13 located in sub-pixel areas of an odd-numbered row is different from a clock signal required by pixel driving circuits 13 located in sub-pixel areas of an even-numbered row. Therefore, in FIG. 6, the clock signal CK is, for example, a clock signal corresponding to the pixel driving circuits 13 in the sub-pixel areas of an odd-numbered row, and the clock signal CB is, for example, a clock signal corresponding to the pixel driving circuits 13 in the sub-pixel areas of an even-numbered row. Driving methods of the pixel driving circuits 13 in the sub-pixel areas of an odd-numbered row and the pixel driving circuits 13 in the sub-pixel areas of an even-numbered row are the same, which will not be repeated herein.

In some embodiments, as shown in FIGS. 5C and 5D, the reset sub-circuit 203 is electrically connected to the first reset signal terminal Rst1 and the second reset signal terminal Rst2.

Figure 7A:
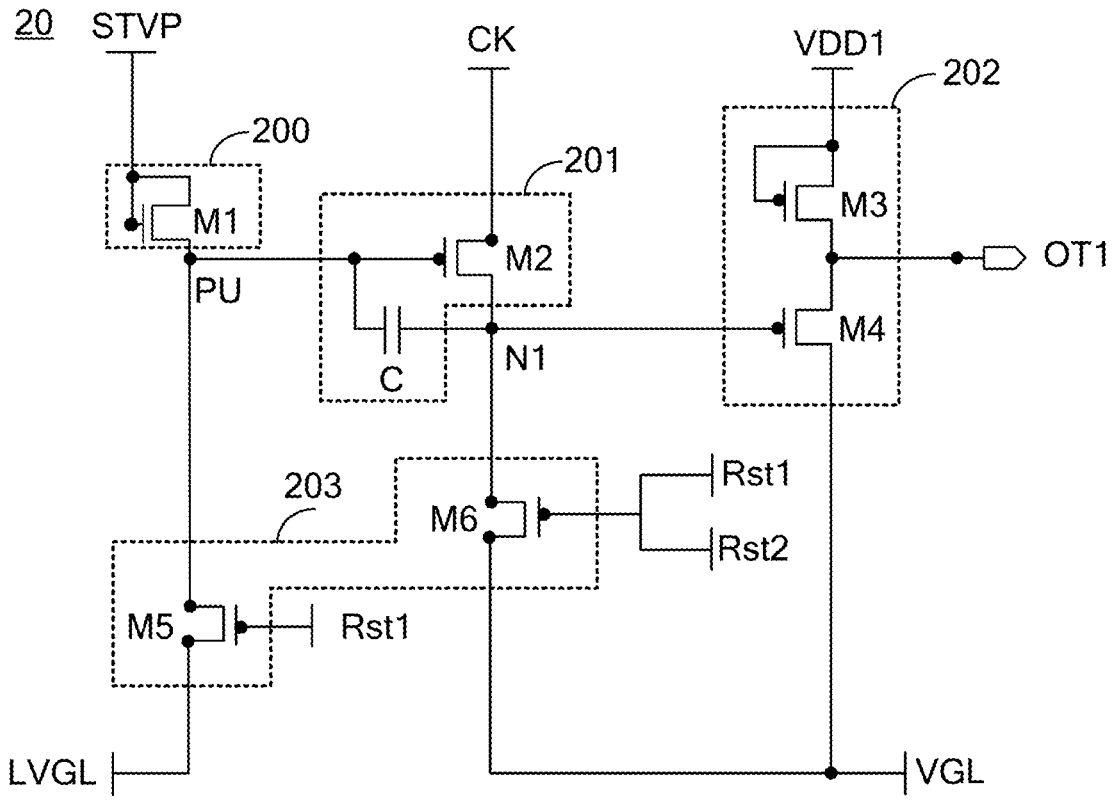
FIG. 7A is a structural diagram of yet another shift register, in accordance with some embodiments.

On this basis, in some examples, as shown in FIG. 7A, the reset sub-circuit 203 includes a fifth transistor M5 and a sixth transistor M6.

A control electrode (i.e., gate) of the fifth transistor M5 is electrically connected to the first reset signal terminal Rst1, a first electrode of the fifth transistor M5 is electrically connected to the third voltage signal terminal LVGL, and a second electrode of the fifth transistor M5 is electrically connected to the pull-up node PU.

A control electrode (i.e., gate) of the sixth transistor M6 is electrically connected to the first reset signal terminal Rst1 and the second reset signal terminal Rst2, a first electrode of the sixth transistor M6 is electrically connected to the second voltage signal terminal VGL, and a second electrode of the sixth transistor M6 is electrically connected to the first node N1.

Figure 8:
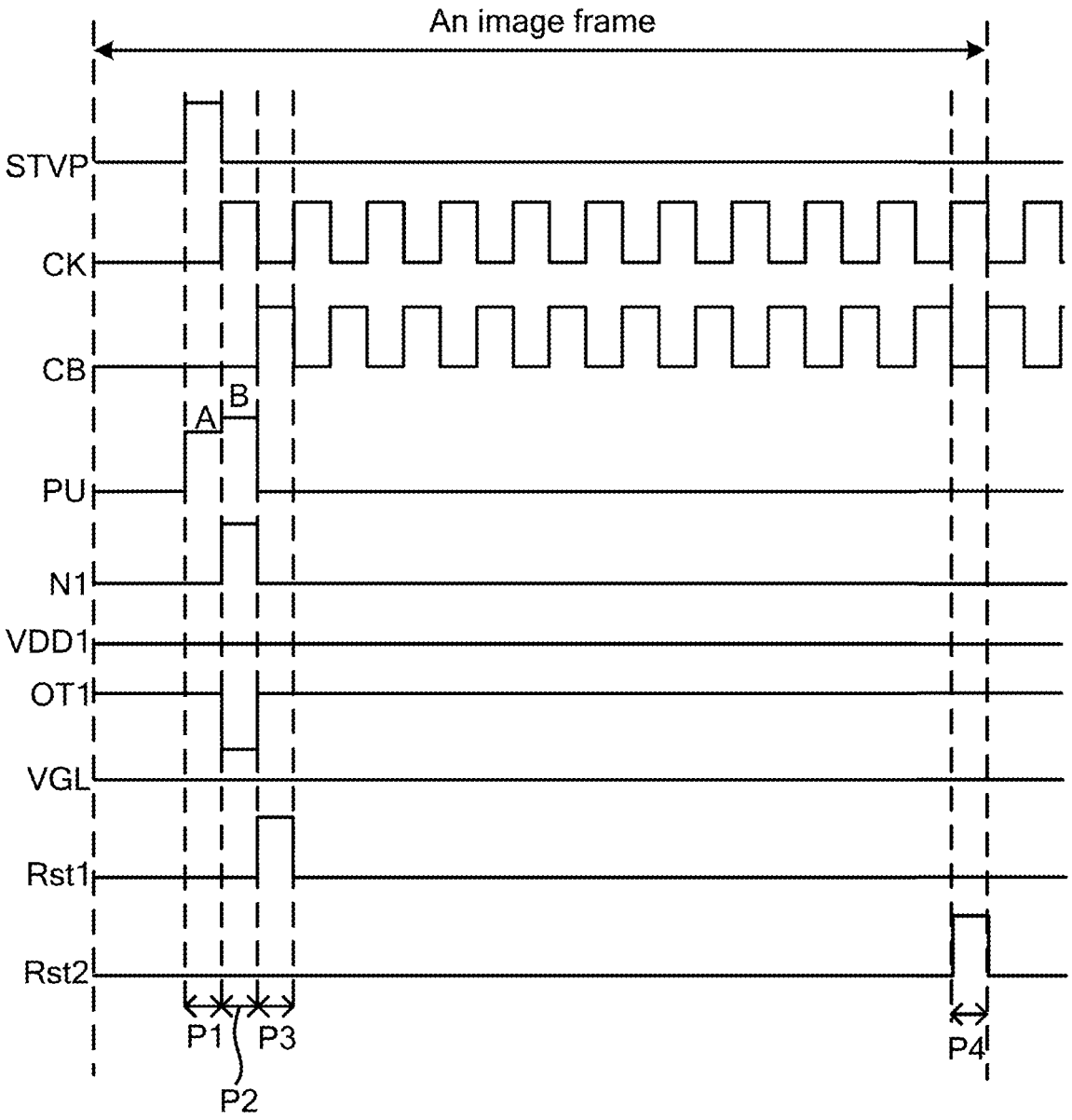
FIG. 8 is a timing diagram of another shift register, in accordance with some embodiments.

In this case, the working process of the shift register 20 further includes a fourth period P4. The fourth period P4, for example, is performed in all shift registers 20 after the second period P2 of a last-stage shift register 20. FIG. 8 illustrates a timing diagram of the shift register 20. The working processes in the first period P1 and the second period 2 are the same as the descriptions of the foregoing embodiments, which will not be repeated here.

In the third period P3, as shown in FIGS. 7A and 8, the fifth transistor M5 and the sixth transistor M6 are turned on in response to the high voltage received from the first reset signal terminal Rst1. The third voltage signal from the third voltage signal terminal LVGL is transmitted to the pull-up node PU through the fifth transistor M5 to reset the pull-up node PU, and the second voltage signal from the second voltage signal terminal VGL is transmitted to the first node N1 through the sixth transistor M6 to reset the first node N1 for the first time.

In the fourth period P4, the voltage of the input signal from the input signal terminal STVP is a low voltage, the voltage from the first reset signal terminal Rst1 is a low voltage, and a voltage of the second reset signal from the second reset signal terminal Rst2 is a high voltage.

Since the voltage of the input signal from the input signal terminal STVP is a low voltage, the first transistor M1 is turned off, so that the potential of the pull-up node PU is a low potential, and the second transistor M2 is turned off. Since the voltage of the first reset signal is the low voltage, the fifth transistor M5 is turned off.

The sixth transistor M6 is turned on in response to the high voltage received from the second reset signal terminal Rst2, and the second voltage signal from the second voltage signal terminal VGL is transmitted to the first node N1 through the sixth transistor M6 to reset the first node N1 for the second time, which is used to prepare for the normal display of the next frame.

In the fourth period P4, the potential of the first node N1 is a low potential, and thus the fourth transistor M4 is turned off. The third transistor M3 remains on in response to the first voltage signal received from the first voltage signal terminal VDD1, the first voltage signal is transmitted to the first output signal terminal OT1 through the third transistor M3, and the first output signal terminal OT1 transmits the first voltage signal.

Figure 7B:
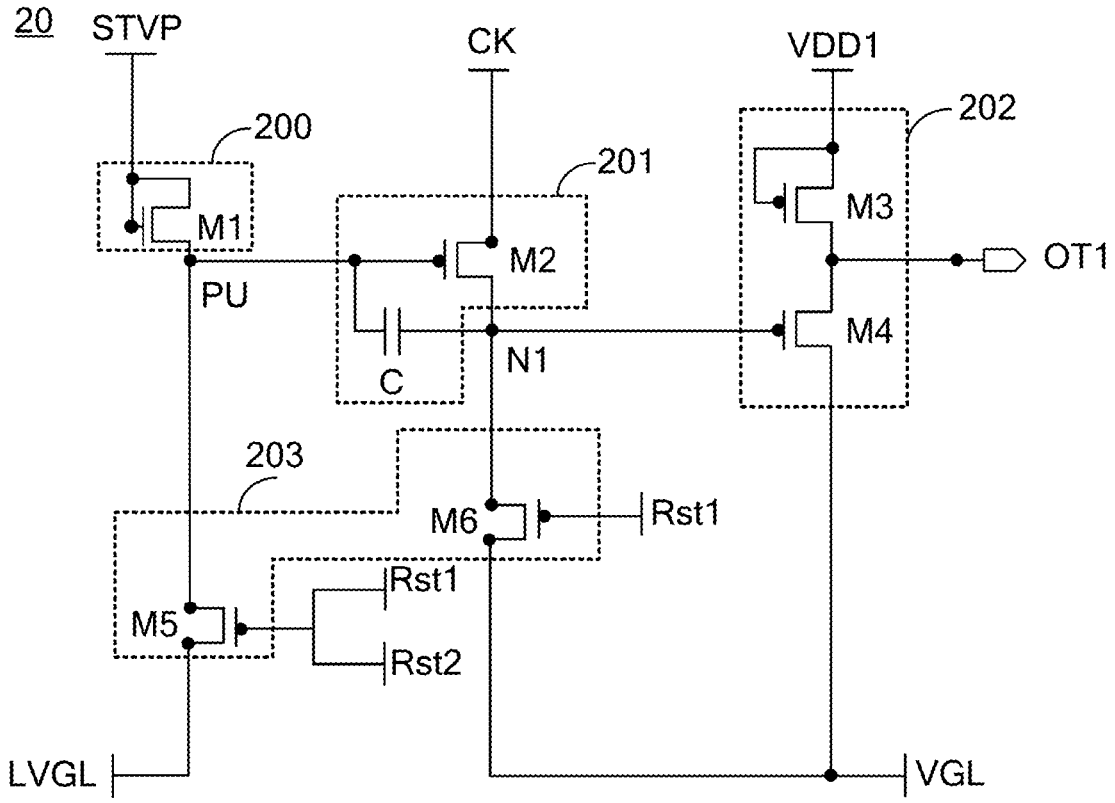
FIG. 7B is a structural diagram of yet another shift register, in accordance with some embodiments.

On this basis, in some other examples, as shown in FIG. 7B, the reset sub-circuit 203 includes a fifth transistor M5 and a sixth transistor M6.

A control electrode (i.e., gate) of the fifth transistor M5 is electrically connected to the first reset signal terminal Rst1 and the second reset signal terminal Rst2, a first electrode of the fifth transistor M5 is electrically connected to the third voltage signal terminal LVGL, and a second electrode of the fifth transistor M5 is electrically connected to the pull-up node PU.

A control electrode (i.e., gate) of the sixth transistor M6 is electrically connected to the first reset signal terminal Rst1, a first electrode of the sixth transistor M6 is electrically connected to the second voltage signal terminal VGL, and a second electrode of the sixth transistor M6 is electrically connected to the first node N1.

In this case, the working process of the shift register 20 further includes a fourth period P4. The fourth period P4, for example, is performed in all shift registers 20 after the second period P2 of a last-period shift register 20. FIG. 8 illustrates a timing diagram of the shift register 20. The working processes in the first period P1 and the second period 2 are the same as the descriptions of the foregoing embodiments, which will not be repeated here.

In the third period P3, as shown in FIGS. 7B and 8, period the fifth transistor M5 and the sixth transistor M6 are turned on in response to the high voltage received from the first reset signal terminal Rst1. The third voltage signal from the third voltage signal terminal LVGL is transmitted to the pull-up node PU through the fifth transistor M5 to reset the pull-up node PU for the first time, and the second voltage signal from the second voltage signal terminal VGL is transmitted to the first node N1 through the sixth transistor M6 to reset the first node N1.

In the fourth period P4, the voltage of the input signal from the input signal terminal STVP is a low voltage, the voltage from the first reset signal terminal Rst1 is a low voltage, and the voltage of the second reset signal from the second reset signal terminal Rst2 is a high voltage.

Since the voltage of the input signal from the input signal terminal STVP is the low voltage, the first transistor M1 is turned off, so that the potential of the pull-up node PU is a low potential, and the second transistor M2 is turned off. The voltage of the first reset signal is the low voltage, and thus the sixth transistor M6 is turned off.

The fifth transistor M5 is turned on in response to the high voltage received from the second reset signal terminal Rst2, and the third voltage signal from the third voltage signal terminal LVGL is transmitted to the pull-up node PU through the fifth transistor M5 to reset the pull-up node PU for the second time, which is used to prepare for the normal display of the next frame.

In the fourth period P4, the potential of the first node N1 is a low potential, and thus the fourth transistor M4 is turned off. The third transistor M3 remains on in response to the first voltage signal received from the first voltage signal terminal VDD1, the first voltage signal is transmitted to the first output signal terminal OT1 through the third transistor M3, and the first output signal terminal OT1 transmits the first voltage signal.

Figure 7C:
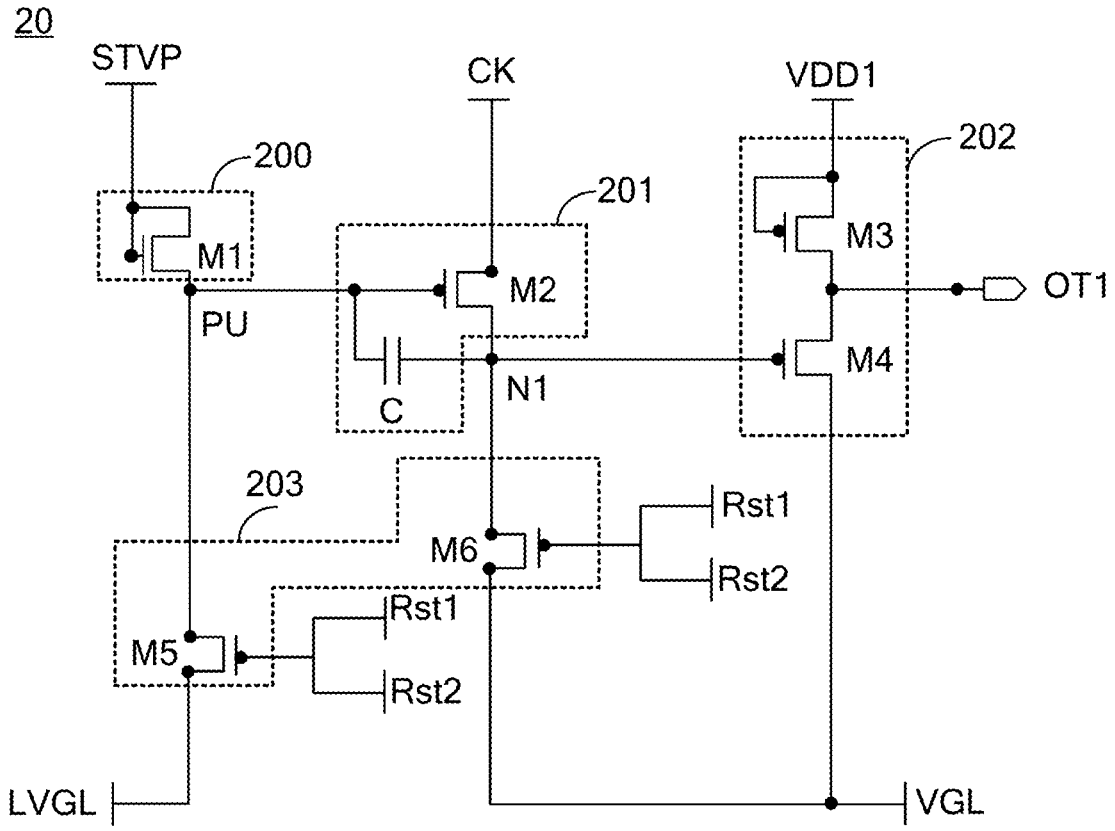
FIG. 7C is a structural diagram of yet another shift register, in accordance with some embodiments.

On this basis, in yet some other examples, as shown in FIG. 7C, the reset sub-circuit 203 includes a fifth transistor M5 and a sixth transistor M6.

A control electrode (i.e., gate) of the fifth transistor M5 is electrically connected to the first reset signal terminal Rst1 and the second reset signal terminal Rst2, a first electrode of the fifth transistor M5 is electrically connected to the third voltage signal terminal LVGL, and a second electrode of the fifth transistor M5 is electrically connected to the pull-up node PU.

A control electrode (i.e., gate) of the sixth transistor M6 is electrically connected to the first reset signal terminal Rst1 and the second reset signal terminal Rst2, a first electrode of the sixth transistor M6 is electrically connected to the second voltage signal terminal VGL, and a second electrode of the sixth transistor M6 is electrically connected to the first node N1.

In this case, the working process of the shift register 20 further includes a fourth period P4. The fourth period P4, for example, is performed in all shift registers 20 after the second period P2 of a last-period shift register 20. FIG. 8 illustrates a timing diagram of the shift register 20. The working processes in the first period P1 and the second period 2 are the same as the descriptions of the foregoing embodiments, which will not be repeated here.

In the third period P3, as shown in FIGS. 7C and 8, the fifth transistor M5 and the sixth transistor M6 are turned on in response to the high voltage received from the first reset signal terminal Rst1. In this way, the third voltage signal from the third voltage signal terminal LVGL is transmitted to the pull-up node PU through the fifth transistor M5 to reset the pull-up node PU for the first time, and the second voltage signal from the second voltage signal terminal VGL is transmitted to the first node N1 through the sixth transistor M6 to reset the first node N1 for the first time.

In the fourth period P4, the voltage of the input signal from the input signal terminal STVP is a low voltage, the voltage from the first reset signal terminal Rst1 is a low voltage, and the voltage of the second reset signal from the second reset signal terminal Rst2 is a high voltage.

Since the voltage of the input signal from the input signal terminal STVP is the low voltage, the first transistor M1 is turned off, so that the potential of the pull-up node PU is a low potential, the second transistor M2 is turned off.

The fifth transistor M5 and the sixth transistor M6 are turned on in response to the high voltage received from the second reset signal terminal Rst2. In this way, the third voltage signal from the third voltage signal terminal LVGL is transmitted to the pull-up node PU through the fifth transistor M5 to reset the pull-up node PU for the second time, and the second voltage signal from the second voltage signal terminal VGL is transmitted to the first node N1 through the sixth transistor M6 to reset the first node N1 for the second time.

The potential of the first node N1 is a low potential, and thus the fourth transistor M4 is turned off. The third transistor M3 remains on in response to the first voltage signal received from the first voltage signal terminal VDD1, the first voltage signal is transmitted to the first output signal terminal OT1 through the third transistor M3, and the first output signal terminal OT1 transmits the first voltage signal.

In this way, in the shift register 20 shown in any one of FIGS. 7A to 7C, at least one of the pull-up node PU and the first node N1 can be reset twice, which may further improve the accuracy of resetting the pull-up node PU and the first node N1, so as to ensure that both the pull-up node PU and the first node N1 have been reset by the time the next frame is displayed.

In some other embodiments, the reset sub-circuit 203 is electrically connected to the first reset signal terminal Rst1 and the second reset signal terminal Rst2.

As shown in FIGS. 11A to 11D, the reset sub-circuit 203 includes a fifth transistor M5, a sixth transistor M6 and an eleventh transistor M11.

A control electrode (i.e., gate) of the fifth transistor M5 is electrically connected to the first reset signal terminal Rst1, a first electrode of the fifth transistor M5 is electrically connected to the third voltage signal terminal LVGL, and a second electrode of the fifth transistor M5 is electrically connected to the pull-up node PU.

Figure 11A:
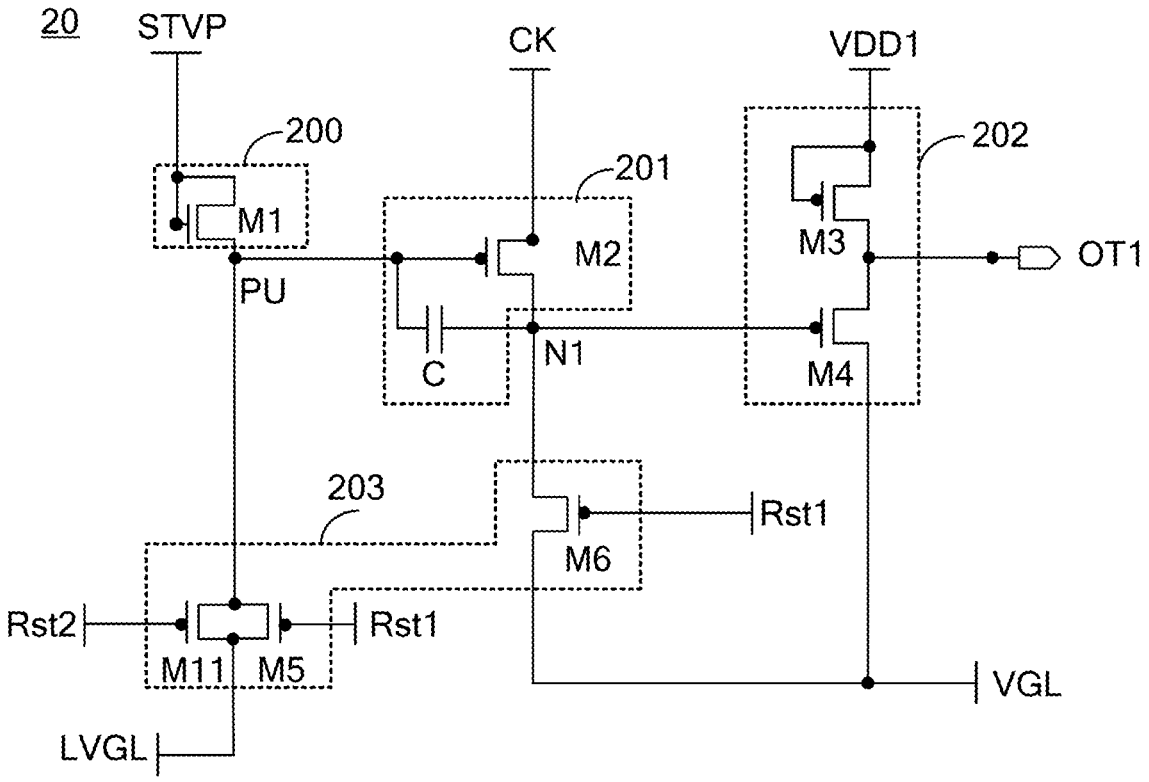
FIG. 11A is a structural diagram of yet another shift register, in accordance with some embodiments.
Figure 11B:
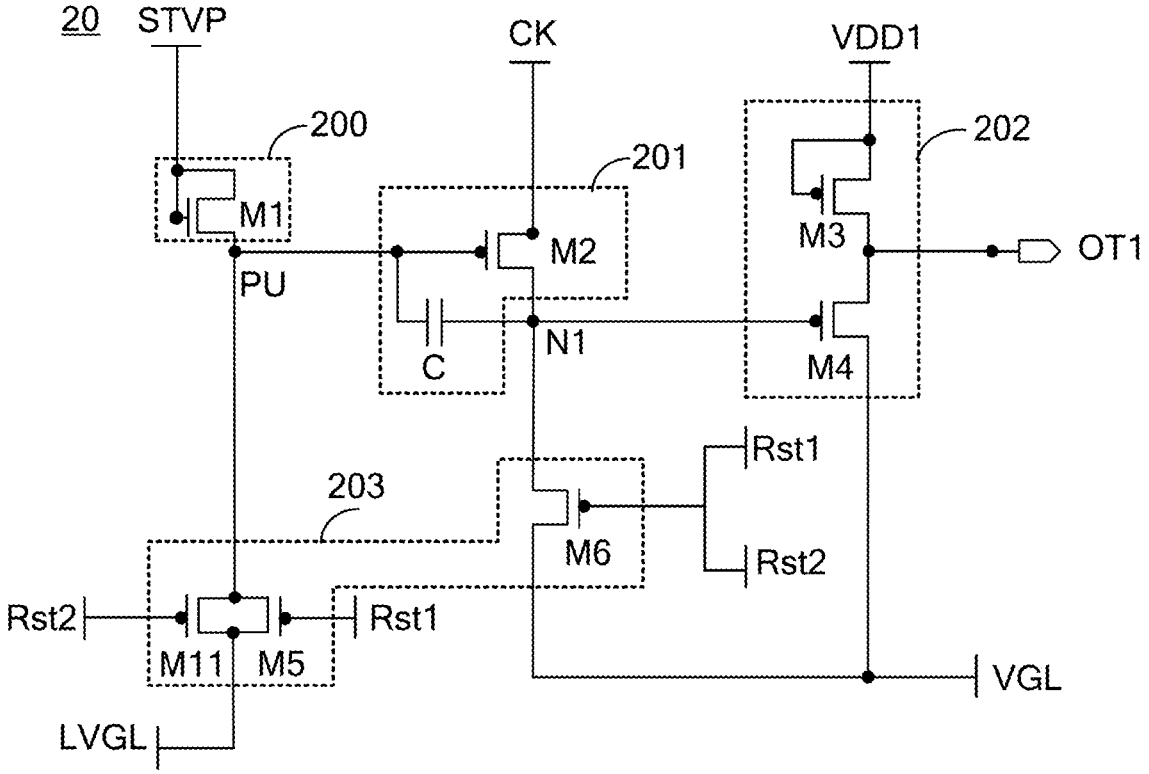
FIG. 11B is a structural diagram of yet another shift register, in accordance with some embodiments.
Figure 11C:
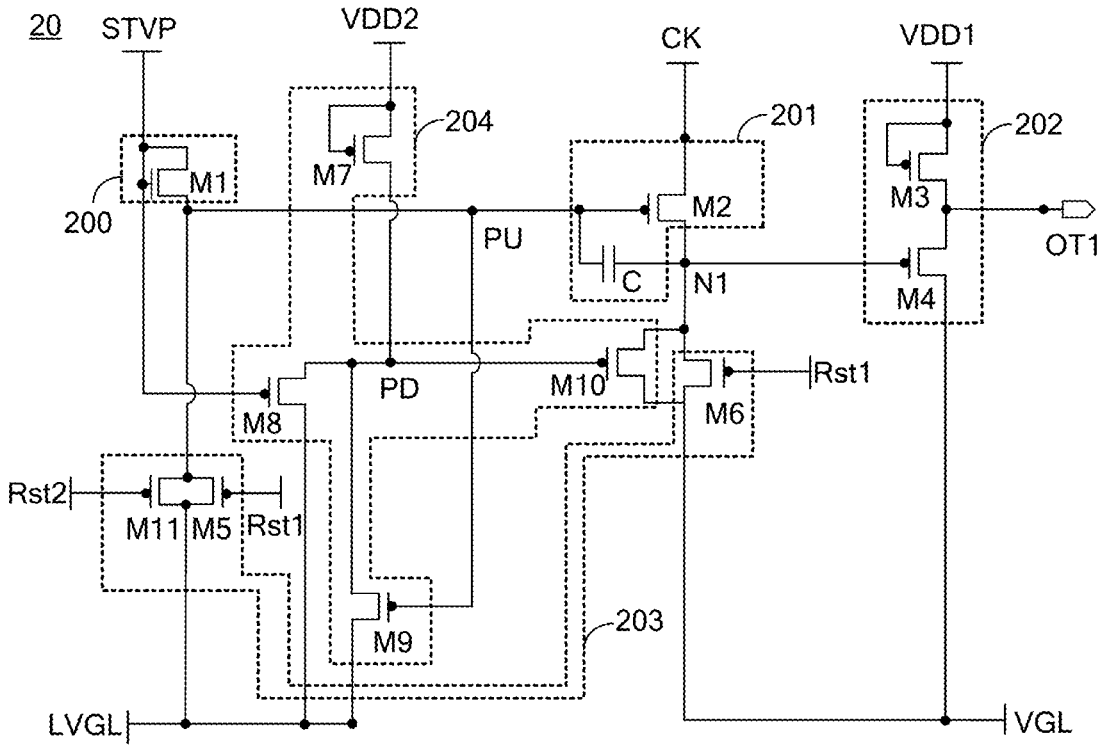
FIG. 11C is a structural diagram of yet another shift register, in accordance with some embodiments.
Figure 11D:
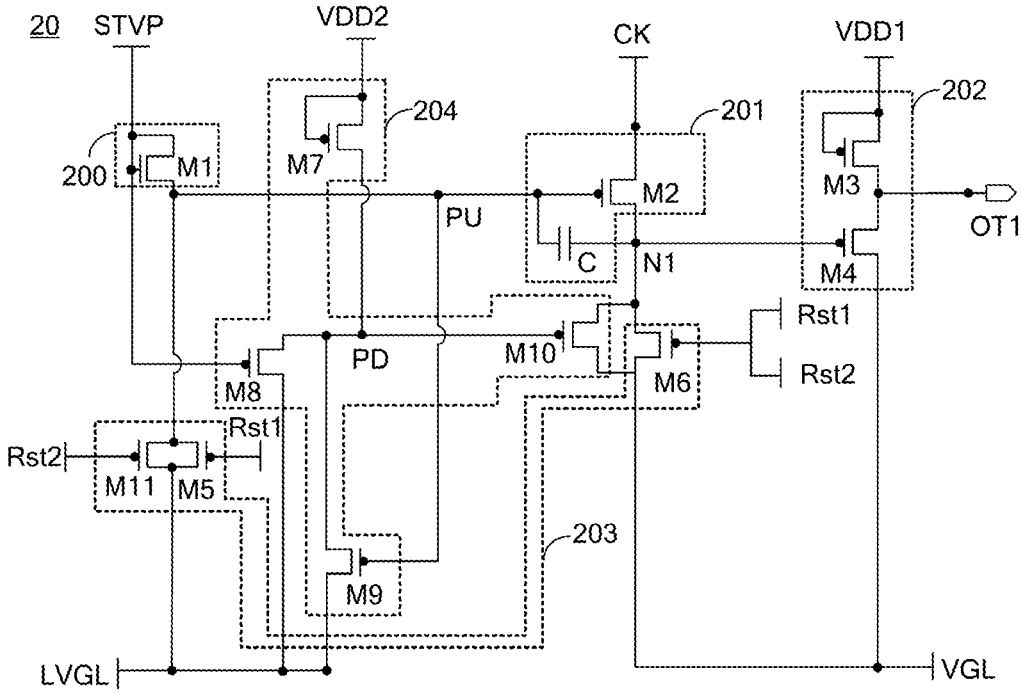
FIG. 11D is a structural diagram of yet another shift register, in accordance with some embodiments.

A control electrode (i.e., gate) of the sixth transistor M6 is electrically connected to the first reset signal terminal Rst1 (as shown in FIGS. 11A and 11C), or a control electrode (i.e., gate) of the sixth transistor M6 is electrically connected to the first reset signal terminal Rst1 and the second reset signal terminal Rst2 (as shown in FIGS. 11B and 11D). A first electrode of the sixth transistor M6 is electrically connected to the second voltage signal terminal VGL, and a second electrode of the sixth transistor M6 is electrically connected to the first node N1.

A control electrode (i.e., gate) of the eleventh transistor M11 is electrically connected to the second reset signal terminal Rst2, a first electrode of the eleventh transistor M11 is electrically connected to the third voltage signal terminal LVGL, and a second electrode of the eleventh transistor M11 is electrically connected to the pull-up node PU.

In this case, the working process of the shift register 20 further includes a fourth period P4. The fourth period P4, for example, is performed in all shift registers 20 after the second period P2 of a last-period shift register 20. FIG. 8 illustrates a timing diagram of the shift register 20. The working processes in the first period P1 and the second period 2 are the same as the descriptions of the foregoing embodiments, which will not be repeated here.

In the fourth period P4, a voltage of the second reset signal from the second reset signal terminal Rst2 is a high voltage The shift register 20 shown in FIGS. 11A and 11C is taken as an example, and as shown in FIG. 8, the eleventh transistor M11 is turned on in response to the high voltage received from the second reset signal terminal Rst2 in the fourth period P4. In this way, the third voltage signal from the third voltage signal terminal LVGL is transmitted to the pull-up node PU through the eleventh transistor M11 to reset the pull-up node PU for the second time.

Or, the shift register 20 shown in FIGS. 11B and 11D is taken as an example, and as shown in FIG. 8, the eleventh transistor M11 and the sixth transistor M6 are turned on in response to the high voltage received from the second reset signal terminal Rst2 in the fourth period P4. In this way, the third voltage signal from the third voltage signal terminal LVGL is transmitted to the pull-up node PU through the eleventh transistor M11 to reset the pull-up node PU for the second time, and the second voltage signal from the second voltage signal terminal VGL is transmitted to the first node N1 through the sixth transistor M6 to reset the first node N1 for the second time.

The second reset signal from the second reset signal terminal Rst2 is used to reset the pull-up node PU and the first node N1 again in the fourth period P4 after the third period P3 of the image frame to ensure that the pull-up node PU and the first node N1 are completely reset, thereby avoiding an extra output of the first output signal terminal OT1 caused due to the presence of a residual voltage on the pull-up node PU and the first node N1. Thus, an effect of an image displayed may be ensured.

In a case where the reset sub-circuit 203 further includes the eleventh transistor M11, the reset sub-circuit 203 can reset the pull-up node PU twice through the fifth transistor M5 and the eleventh transistor M11, which may ensure that the pull-up node PU has been reset before the next frame starts.

In some embodiments, as shown in FIGS. 9A, 9B and 11C to 11D, the denoising sub-circuit 204 includes a seventh transistor M7, an eighth transistor M8, a ninth transistor M9 and a tenth transistor M10.

A control electrode (i.e., gate) and a first electrode of the seventh transistor M7 are electrically connected to the fourth voltage signal terminal VDD2, and a second electrode of the seventh transistor M7 is electrically connected to a pull-down node PD.

A control electrode (i.e., gate) of the eighth transistor M8 is electrically connected to the input signal terminal STVP, a first electrode of the eighth transistor M8 is electrically connected to the third voltage signal terminal LVGL, and a second electrode of the eighth transistor M8 is electrically connected to the pull-down node PD.

A control electrode (i.e., gate) of the ninth transistor M9 is electrically connected to the pull-up node PU, a first electrode of the ninth transistor M9 is electrically connected to the third voltage signal terminal LVGL, and a second electrode of the ninth transistor M9 is electrically connected to the pull-down node PD.

For example, both a width-to-length ratio of a channel of the eighth transistor M8 and a width-to-length ratio of a channel of the ninth transistor M9 are greater than a width-to-length ratio of a channel of the seventh transistor M7.

A control electrode (i.e., gate) of the tenth transistor M10 is electrically connected to the pull-down node PU, a first electrode of the tenth transistor M10 is electrically connected to the second voltage signal terminal VGL, and a second electrode of the tenth transistor M10 is electrically connected to the first node N1.

Figure 9A:
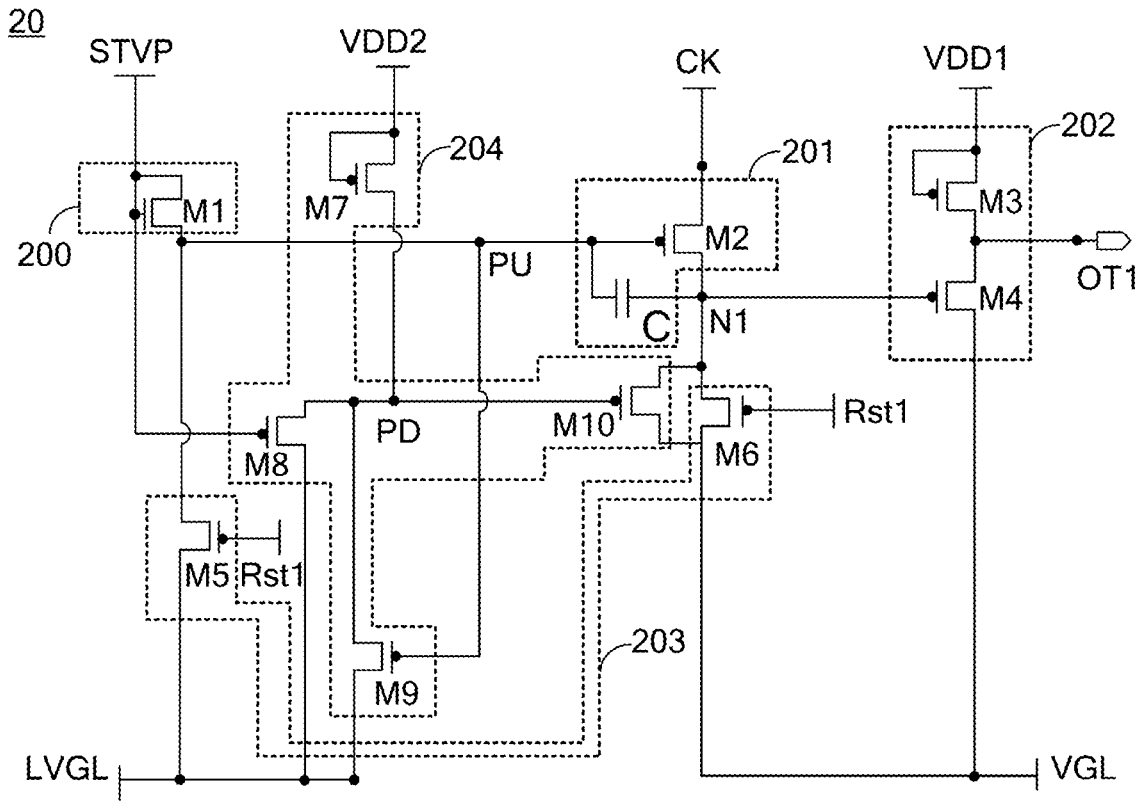
FIG. 9A is a structural diagram of yet another shift register, in accordance with some embodiments.
Figure 9B:
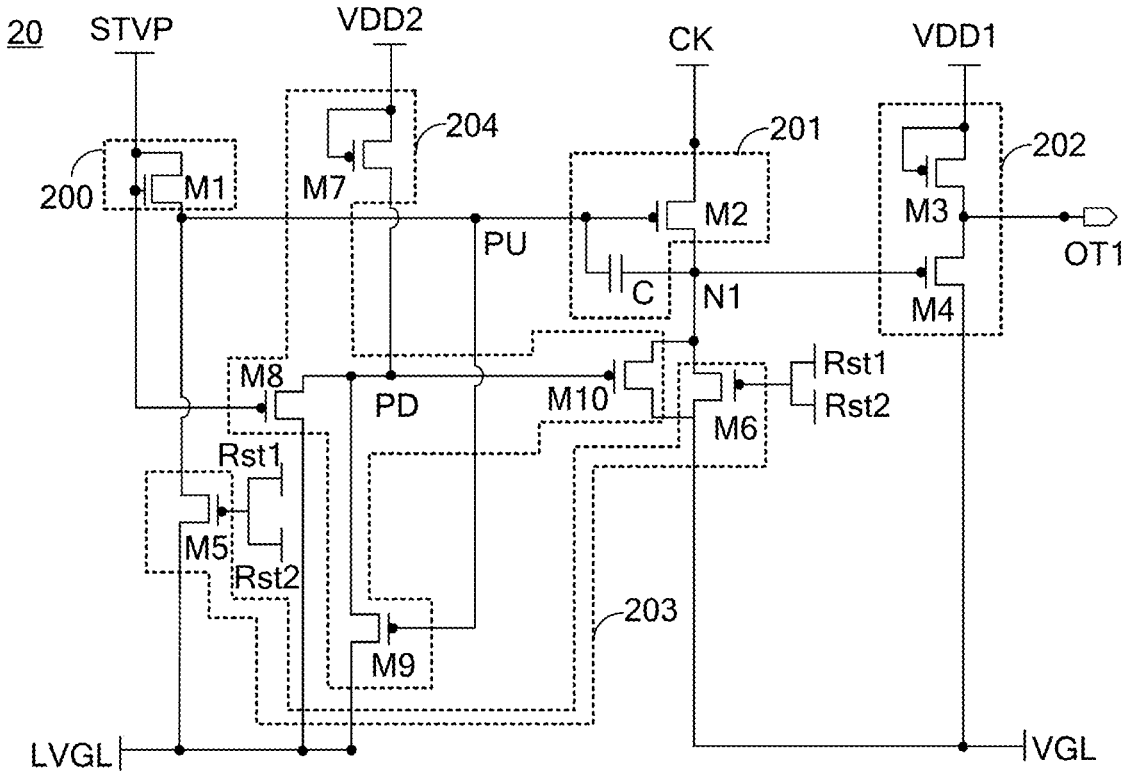
FIG. 9B is a structural diagram of yet another shift register, in accordance with some embodiments.
Figure 10:
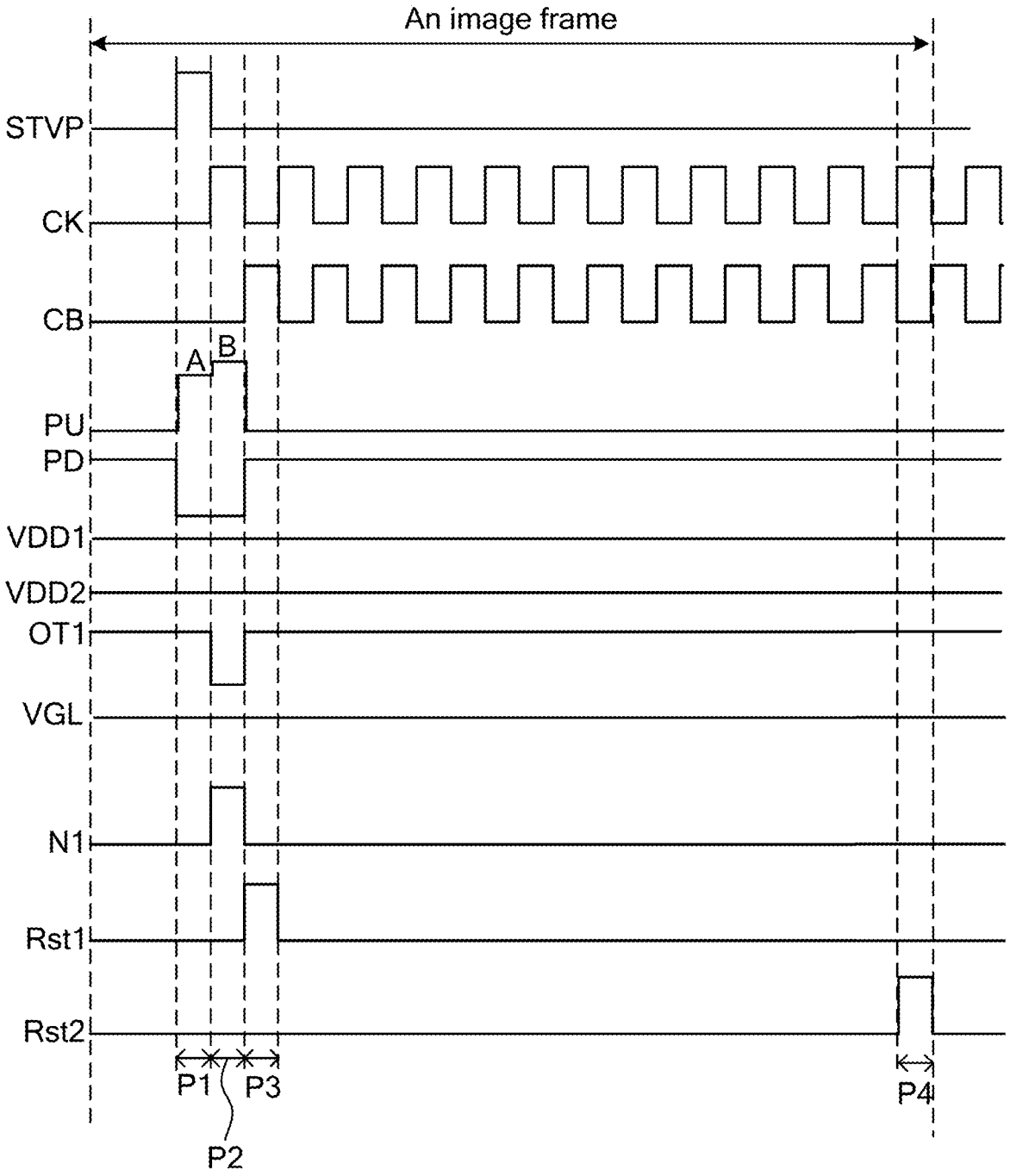
FIG. 10 is a timing diagram of yet another shift register, in accordance with some embodiments.

The shift register 20 shown in FIGS. 9A and 9B is taken as an example, FIG. 10 illustrates a timing diagram of the shift register 20.

As shown in FIGS. 9A, 9B and 10, in the first period P1, the seventh transistor M7 is turned on in response to the fourth voltage signal received from the fourth voltage signal terminal VDD2, and the fourth voltage signal is transmitted to the pull-down node PD through the seventh transistor M7.

The voltage of the input signal from the input signal terminal STVP is a high voltage, and thus the eighth transistor M8 is turned on in response to the high voltage received from the input signal terminal STVP. After the eighth transistor M8 is turned on, the third voltage signal from the third voltage signal terminal LVGL is transmitted to the pull-down node PD through the eighth transistor M8 to pull down a potential of the pull-down node PD, and then the tenth transistor M10 is turned off.

The ninth transistor M9 is turned on in response to the signal received from the pull-up node PU, and thus the third voltage signal from the third voltage signal terminal LVGL is transmitted to the pull-down node PD through the ninth transistor M9 to further pull down the potential of the pull-down node PD, which further ensures that the tenth transistor M10 is in an off state. The tenth transistor M10 is in the off state, and thus the second voltage signal will not be transmitted to the first node N1. That is, the electrical connection between the second voltage signal terminal VGL and the first node N1 is disconnected.

In the second period P2, the voltage of the input signal from the input signal terminal STVP is a low voltage, and the potential of the pull-up node PU is a high potential.

The voltage of the input signal from the input signal terminal STVP is a low voltage, and thus the eighth transistor M8 is turned off. The ninth transistor M9 remains on in response to a signal from the pull-up node PU, and the third voltage signal is transmitted to the pull-down node PD through the ninth transistor M9 to maintain a low potential of the pull-down node PD. The tenth transistor M10 is in the off state, and thus the second voltage signal will not be transmitted to the first node N1.

In the third period P3 and the fourth period P4, the voltage of the input signal from the input signal terminal STVP is a low voltage, and the potential of the pull-up node PU is changed into a low potential. Therefore, the eighth transistor M8 and the ninth transistor M9 are turned off. The seventh transistor M7 is turned on in response to the fourth voltage signal received from the fourth voltage signal terminal VDD2, and the fourth voltage signal is transmitted to the pull-down node PD through the seventh transistor M7, so that the potential of the pull-down node PD is changed into a high potential.

The pull-down node PD is at a high potential, and thus the tenth transistor M10 is turned on, and the second voltage signal from the second voltage signal terminal VGL is transmitted to the first node N1 through the tenth transistor M10 to pull down the potential of the first node N1, so that the fourth transistor M4 is in the off state.

It will be noted that, the above only describes states in various periods of the seventh transistor M7, the eighth transistor M8, the ninth transistor M9 and the tenth transistor M10 in the denoising sub-circuit 204. Refer to the above for states in various periods of the first transistor M1 to the sixth transistor M6, which will not be repeated herein.

In the shift register 20 provided by some embodiments of the present disclosure, the denoising sub-circuit 204 can pull down the potential of the first node N1 in a period when the first output signal terminal OT1 transmits the first voltage signal, so that the fourth transistor M4 is in the off state, thereby ensuring that the second voltage signal cannot be transmitted from the first output signal terminal OT1, and the first voltage signal can be transmitted from the first output signal terminal OT1: and in a period when the first output signal terminal OT1 transmits the second voltage signal, the denoising sub-circuit 204 can disconnect the electrical connection between the first node N1 and the second voltage signal terminal VGL to ensure that the fourth transistor M4 can be turned on and transmit the second voltage signal to the first output signal terminal OT1.

Figure 11E:
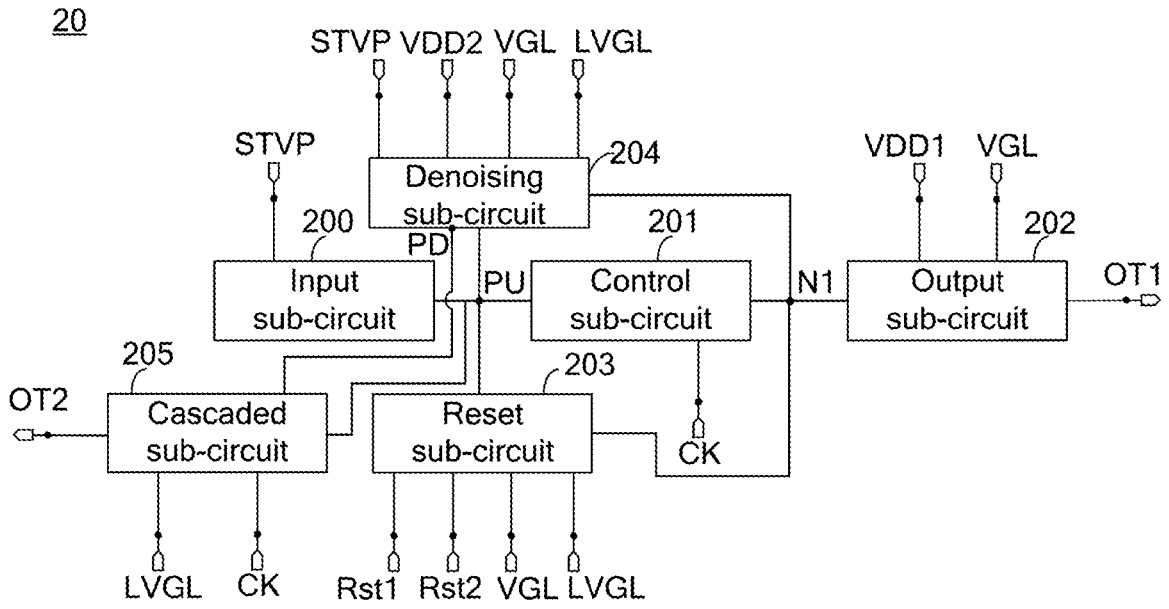
FIG. 11E is a structural diagram of yet another shift register, in accordance with some embodiments.

In some embodiments, as shown in FIG. 11E, the shift register 20 further includes a cascaded sub-circuit 205. The cascaded sub-circuit 205 is electrically connected to the pull-up node PU, the pull-down node PD, the third voltage signal terminal LVGL, the clock signal terminal CK and a second output signal terminal OT2. The cascaded sub-circuit 205 is configured to transmit the clock signal from the clock signal terminal CK to the second output signal terminal OT2 in response to the signal received from the pull-up node PU, and to transmit the third voltage signal from the third voltage signal terminal LVGL to the second output signal terminal OT2 in response to a signal received from the pull-down node PD.

Figure 11F:
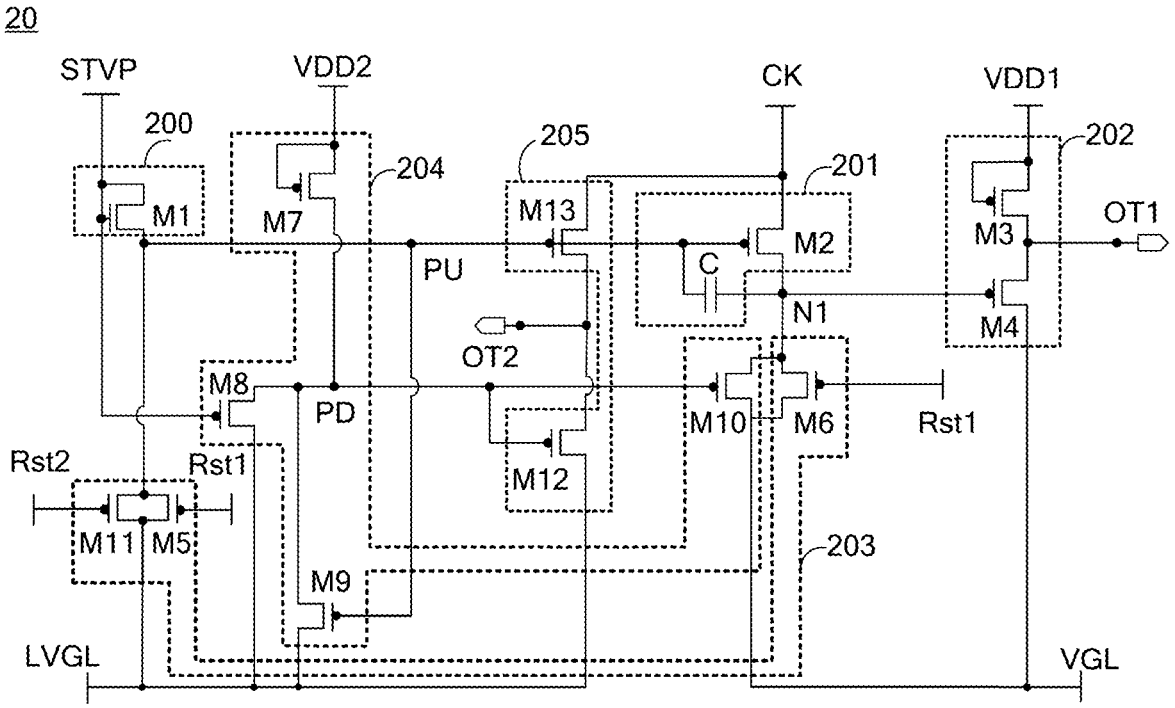
FIG. 11F is a structural diagram of yet another shift register, in accordance with some embodiments.

In some embodiments, as shown in FIG. 11F, the cascaded sub-circuit 205 includes a twelfth transistor M12 and a thirteen transistor M13.

A control electrode (i.e., gate) of the twelfth transistor M12 is electrically connected to the pull-down node PD, a first electrode of the twelfth transistor M12 is electrically connected to the third voltage signal terminal LVGL, and a second electrode of the twelfth transistor M12 is electrically connected to the second output signal terminal OT2. The twelfth transistor M12 is configured to be turned on in response to the signal received from the pull-down node PD, and to transmit the third voltage signal from the third voltage signal terminal LVGL to the second output signal terminal OT2.

A control electrode (i.e., gate) of the thirteen transistor M13 is electrically connected to the pull-up node PU, a first electrode of the thirteen transistor M13 is electrically connected to the clock signal terminal CK, and a second electrode of the thirteen transistor M13 is electrically connected to the second output signal terminal OT2. The thirteen transistor M13 is configured to be turned on in response to the signal received from the pull-up node PU, and to transmit the clock signal from the clock signal terminal CK to the second output signal terminal OT2.

A cascade manner of the plurality of shift registers 20 in the light-emitting control circuit 12 provided by some embodiments of the present disclosure includes the following two possible implementations, according to whether each shift register 20 includes the cascaded sub-circuit 205.

In a case where the shift register 20 does not include the cascaded sub-circuit 205, the cascade manner of the plurality of shift registers 20 in the light-emitting control circuit 12 is a first possible implementation.

As shown in FIG. 4A, each shift register 20 includes the first node N1, and M stages of shift registers 20 are cascaded through the first nodes N1, M is an integer greater than 2. Among the M stages of shift registers 20 of the light-emitting control circuit 12, the first node N1 of a first-stage shift register 20 is electrically connected to the input signal terminal STVP that is electrically connected to a second-stage shift register 20. The first node N1 of an M-th-stage shift register 20 (i.e., last-stage shift register 20) is electrically connected to the first reset signal terminal Rst1 that is electrically connected to an (M−1)-th-stage shift register 20. Except the first-stage shift register 20 and the last-stage shift register 20, the first node N1 of each stage shift register 20 among remaining shift registers 20 is electrically connected to the first reset signal terminal Rst1 that is electrically connected to a previous-stage shift register 20 and the input signal terminal STVP that is electrically connected to a next-stage shift register 20.

The light-emitting control circuit 12 has a simple structure, and the number of TFTs disposed in each shift register 20 is small. In a case where the light-emitting control circuit is disposed in the display panel 1, the light-emitting control circuit 12 occupies a small area in the display panel 1, which is conducive to a narrow bezel design of the display apparatus.

In a case where the shift register 20 includes the cascaded sub-circuit 205, the cascade manner of the plurality of shift registers 20 in the light-emitting control circuit 12 is a second possible implementation.

As shown in FIGS. 4B and 4C, each shift register 20 is electrically connected to the second output signal terminal OT2, M stages of shift registers 20 are cascaded through the second output signal terminals OT2, and M is an integer greater than 2. Among the M stages of cascaded shift registers 20 of the light-emitting control circuit 12, the second output signal terminal OT2 that is electrically connected to a first-stage shift register 20 is electrically connected to the input signal terminal STVP that is electrically connected to a second-stage shift register 20. The second output signal terminal OT2 that is electrically connected to an M-th-stage shift register 20 (i.e., a last-stage shift register 20) is electrically connected to the first reset signal terminal Rst1 that is electrically connected to an (M−1)-th-stage shift register 20. Except the first-stage shift register 20 and the last-stage shift register 20, the second output signal terminal OT2 of each stage shift register 20 among the remaining shift registers 20 is electrically connected to the first reset signal terminal Rst1 that is electrically connected to a previous-stage shift register 20 and the input signal terminal STVP that is electrically connected to a next-stage shift register 20.

The plurality of shift registers 20 in the light-emitting control circuit 12 are connected in a relatively simple manner. The second output signal terminal OT2 is electrically connected to the first reset signal terminal Rst1 that is electrically connected to the previous-stage shift register and the input signal terminal STVP that is electrically connected to the next-stage shift register. The first node N1 is not electrically connected to the first reset signal terminal Rst1 that is electrically connected to the previous-stage shift register and the input signal terminal STVP that is electrically connected to the next-stage shift register, which may reduce an attenuation of the signal on the first node N1, and is beneficial to accurately control a turn-on or turn-off of the fourth transistor M4, thereby making the first output signal transmitted from the first output signal terminal OT1 more stable and more accurate.

In the second possible implementation, for example, as shown in FIG. 4C, each shift register 20 is further electrically connected to a second reset signal terminal Rst2, and the second reset signal terminals Rst2 connected to all the shift registers 20 may be electrically connected together.

The second reset signal terminal Rst2 is configured to receive the second reset signal to reset all the shift registers 20 to avoid a problem of inaccuracy of the enable signal output due to the presence of a residual voltage at the pull-up node PU and the first node N1 in the shift register 20, which improves the working stability of the light-emitting control circuit 12. In addition, by resetting all the shift registers 20 through the second reset signal received by the second reset signal terminal Rst2, it is possible to avoid a charge accumulation caused due to a fact that the first reset signal terminal Rst1 electrically connected to the last-stage shift register 20 is not electrically connected to the other shift registers 20, and the last-stage shift register 20 has not been reset for a long time, which may affect the effect of the image displayed.

In some embodiments, the light-emitting control circuit 12 is electrically connected to the timing controller TCON. The timing controller TCON is further configured to supply the second reset signal to the second reset signal terminal Rst2 that is electrically connected to the light-emitting control circuit 12, and to supply the input signal to the input signal terminal STVP that is electrically connected to the first-stage shift register of the light-emitting control circuit 12.

It will be noted that FIGS. 4A to 4C only illustrate four cascaded shift registers 20 in the light-emitting control circuit 12, however the embodiments of the present disclosure do not limit the number of shift registers 20 in the light-emitting control circuit 12.

Some embodiments of the present disclosure provide a method for driving the shift register 20 as shown in FIG. 5A. The shift register 20 includes the input sub-circuit 200, the control sub-circuit 201, the output sub-circuit 202 and the reset sub-circuit 203.

Figure 12A:
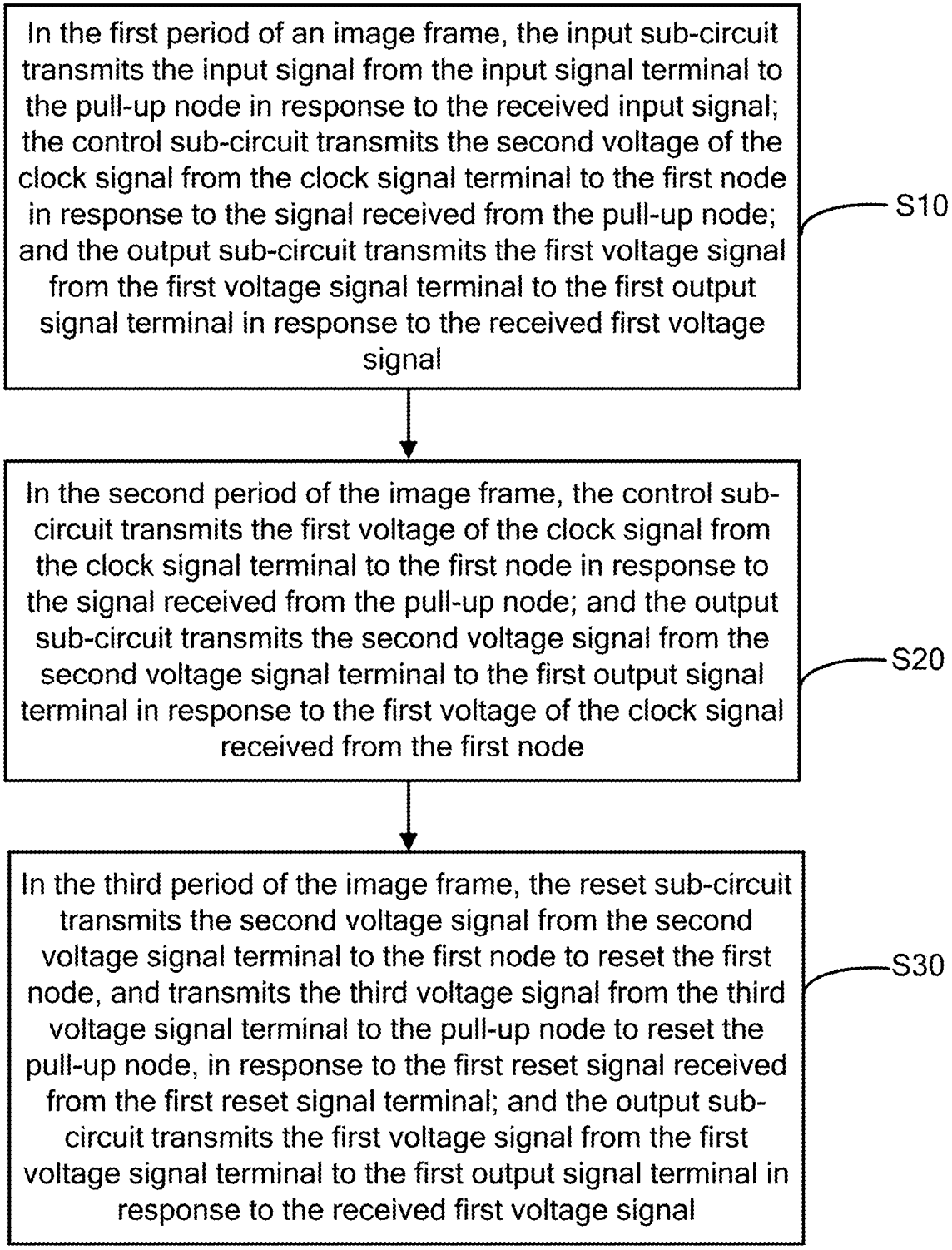
FIG. 12A is a flow diagram of a method for driving a shift register, in accordance with some embodiments.

FIG. 12A illustrates a flow diagram of a method for driving the shift register 20 according to some embodiments. As shown in FIG. 12A, the method includes S10 to S30.

In S10 (in the first period P1 of an image frame), the input sub-circuit 200 transmits the input signal from the input signal terminal STVP to the pull-up node PU in response to the received input signal; the control sub-circuit 201 transmits the second voltage of the clock signal from the clock signal terminal CK to the first node N1 in response to the signal received from the pull-up node PU; and the output sub-circuit 202 transmits the first voltage signal from the first voltage signal terminal VDD1 to the first output signal terminal OT1 in response to the received first voltage signal.

In S20 (in the second period P2 of the image frame), the control sub-circuit 201 transmits the first voltage of the clock signal from the clock signal terminal CK to the first node N1 in response to the signal received from the pull-up node PU; and the output sub-circuit 202 transmits the second voltage signal from the second voltage signal terminal VGL to the first output signal terminal OT1 in response to the first voltage of the clock signal received from the first node N1.

In S30 (in the third period P3 of the image frame), the reset sub-circuit 203, in response to the first reset signal received from the first reset signal terminal Rst1, transmits the second voltage signal from the second voltage signal terminal VGL to the first node N1 to reset the first node N1, and transmits the third voltage signal from the third voltage signal terminal LVGL to the pull-up node PU to reset the pull-up node PU; and the output sub-circuit 202 transmits the first voltage signal from the first voltage signal terminal VDD1 to the first output signal terminal OT1 in response to the received first voltage signal.

Figure 12B:
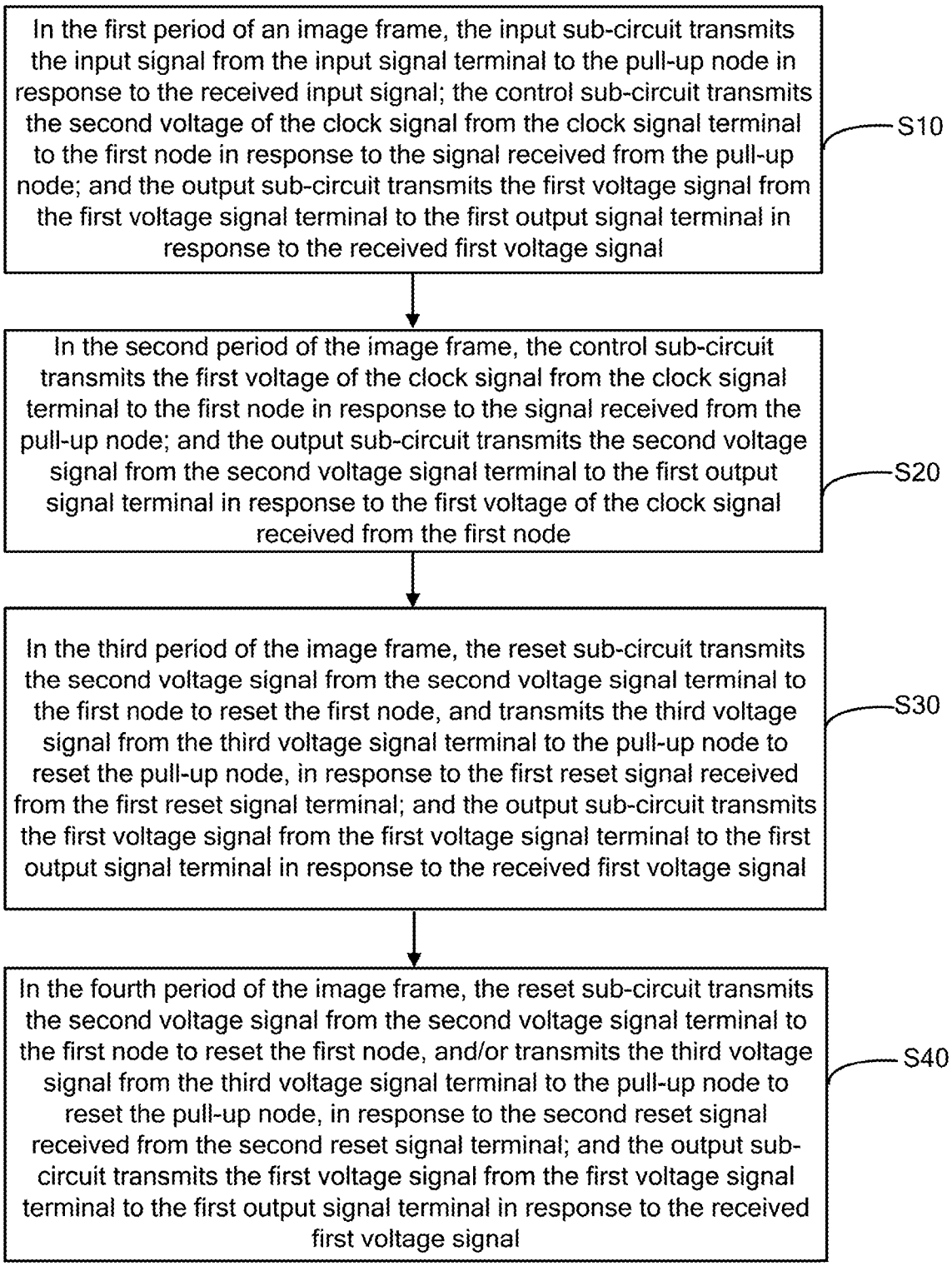
FIG. 12B is a flow diagram of another method for driving a shift register, in accordance with some embodiments.

In some other embodiments, as shown in FIGS. 5C and 5D, the reset sub-circuit 203 in the shift register 20 is further electrically connected to the second reset signal terminal Rst2. In this case, FIG. 12B illustrates a flow diagram of a method for driving the shift register 20 according to some embodiments. As shown in FIG. 12B, on a basis of S10 to S30, the method further includes S40.

In S40 (in the fourth period P4 of the image frame), the reset sub-circuit 203, in response to the second reset signal received from the second reset signal terminal Rst2, transmits the second voltage signal from the second voltage signal terminal VGL to the first node N1 to reset the first node N1, and/or transmits the third voltage signal from the third voltage signal terminal LVGL to the pull-up node PU to reset the pull-up node PU; and the output sub-circuit 202 transmits the first voltage signal from the first voltage signal terminal VDD1 to the first output signal terminal OT1 in response to the received first voltage signal.

Figure 12C:
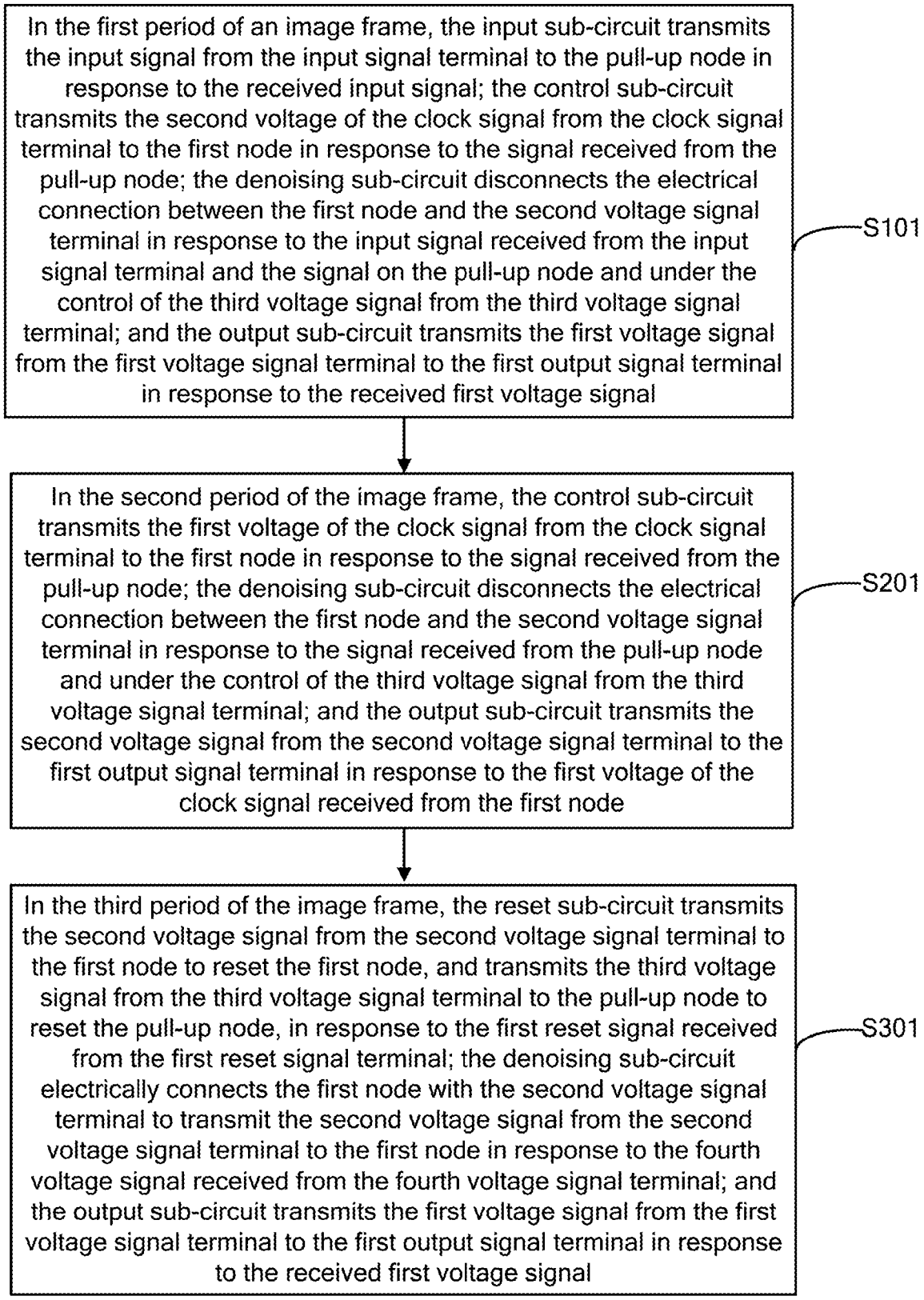
FIG. 12C is a flow diagram of yet another method for driving a shift register, in accordance with some embodiments.

In yet some other embodiments, as shown in FIG. 5B, the shift register 20 includes the input sub-circuit 200, the control sub-circuit 201, the output sub-circuit 202, the reset sub-circuit 203 and the denoising sub-circuit 204. In this case, FIG. 12C illustrates a flow diagram of a method for driving the shift register 20 according to some embodiments. As shown in FIG. 12C, the method includes S101 to S301.

In S101 (in the first period P1 of an image frame), the input sub-circuit 200 transmits the input signal from the input signal terminal STVP to the pull-up node PU in response to the received input signal; the control sub-circuit 201 transmits the second voltage of the clock signal from the clock signal terminal CK to the first node N1 in response to the signal received from the pull-up node PU; the denoising sub-circuit 204 disconnects the electrical connection between the first node N1 and the second voltage signal terminal VGL, in response to the input signal received from the input signal terminal STVP and the signal on the pull-up node PU, and under the control of the third voltage signal from the third voltage signal terminal LVGL; and the output sub-circuit 202 transmits the first voltage signal from the first voltage signal terminal VDD1 to the first output signal terminal OT1 in response to the received first voltage signal.

In S201 (in the second period P2 of the image frame), the control sub-circuit 201 transmits the first voltage of the clock signal from the clock signal terminal CK to the first node N1 in response to the signal received from the pull-up node PU; the denoising sub-circuit 204 disconnects the electrical connection between the first node N1 and the second voltage signal terminal VGL, in response to the signal received from the pull-up node PU and under the control of the third voltage signal from the third voltage signal terminal LVGL; and the output sub-circuit 202 transmits the second voltage signal from the second voltage signal terminal VGL to the first output signal terminal OT1 in response to the first voltage of the clock signal received from the first node N1.

In S301 (in the third period P3 of the image frame), the reset sub-circuit 203, in response to the first reset signal received from the first reset signal terminal Rst1, transmits the second voltage signal from the second voltage signal terminal VGL to the first node N1 to reset the first node N1, and transmits the third voltage signal from the third voltage signal terminal LVGL to the pull-up node PU to reset the pull-up node PU; the denoising sub-circuit 204 electrically connects the first node N1 with the second voltage signal terminal VGL to transmit the second voltage signal from the second voltage signal terminal VGL to the first node N1 in response to the fourth voltage signal received from the fourth voltage signal terminal VDD2; and the output sub-circuit 202 transmits the first voltage signal from the first voltage signal terminal VDD1 to the first output signal terminal OT1 in response to the received first voltage signal.

It will be noted that, in the sub-circuit/circuit provided by the embodiments of the present disclosure, the nodes such as the first node (i.e., the control node), the second node, the third node, the pull-up node, and the pull-down node do not necessarily represent actual existing components. In some examples, these nodes represent junctions of related electrical connections in the circuit diagram, that is, these nodes are equivalent to the junctions of the related electrical connections in the circuit diagram.

The foregoing descriptions are merely specific implementations of the present disclosure, but the protection scope of the present disclosure is not limited thereto. Any person skilled in the art could conceive of changes or replacements within the technical scope of the present disclosure, which shall all be included in the protection scope of the present disclosure. Therefore, the protection scope of the present disclosure shall be subject to the protection scope of the claims.

What is claimed is:

1. A shift register, comprising:

an input sub-circuit electrically connected to an input signal terminal and a pull-up node, wherein the input sub-circuit is configured to transmit an input signal from the input signal terminal to the pull-up node in response to the received input signal;

a control sub-circuit electrically connected to the pull-up node, a clock signal terminal and a control node, wherein the control sub-circuit is configured to store a signal on the pull-up node, and to transmit a clock signal from the clock signal terminal to the control node in response to the signal received from the pull-up node;

an output sub-circuit electrically connected to the control node, a first voltage signal terminal, a second voltage signal terminal and a first output signal terminal, wherein the output sub-circuit is configured to transmit a second voltage signal from the second voltage signal terminal to the first output signal terminal in response to the clock signal received from the control node, and to transmit a first voltage signal from the first voltage signal terminal to the first output signal terminal in response to the received first voltage signal;

a reset sub-circuit electrically connected to a first reset signal terminal, the control node, the pull-up node, the second voltage signal terminal and a third voltage signal terminal, wherein the reset sub-circuit is configured to transmit the second voltage signal from the second voltage signal terminal to the control node to reset the control node, and to transmit a third voltage signal from the third voltage signal terminal to the pull-up node to reset the pull-up node, in response to a first reset signal received from the first reset signal terminal; and a denoising sub-circuit electrically connected to a fourth voltage signal terminal, the input signal terminal, the pull-up node, the second voltage signal terminal, the third voltage signal terminal and the control node, wherein the denoising sub-circuit is configured to control a line between the control node and the second voltage signal terminal to be closed in response to a fourth voltage signal received from the fourth voltage signal terminal, so as to transmit the second voltage signal from the second voltage signal terminal to the control node, and to control the line between the control node and the second voltage signal terminal to be opened in response to the input signal received from the input signal terminal and the signal on the pull-up node and under a control of the third voltage signal from the third voltage signal terminal.

2. The shift register according to claim 1, wherein the reset sub-circuit is further electrically connected to a second reset signal terminal; and the reset sub-circuit is further configured to transmit the second voltage signal from the second voltage signal terminal to the control node to reset the control node, and/or to transmit the third voltage signal from the third voltage signal terminal to the pull-up node to reset the pull-up node, in response to a second reset signal received from the second reset signal terminal.

3. The shift register according to claim 2, wherein the reset sub-circuit includes a fifth transistor and a sixth transistor;

a first electrode of the fifth transistor is electrically connected to the third voltage signal terminal, and a second electrode of the fifth transistor is electrically connected to the pull-up node; and a first electrode of the sixth transistor is electrically connected to the second voltage signal terminal, and a second electrode of the sixth transistor is electrically connected to the control node; and a control electrode of the fifth transistor is electrically connected to the first reset signal terminal, and a control electrode of the sixth transistor is electrically connected to the first reset signal terminal and the second reset signal terminal; or the control electrode of the fifth transistor is electrically connected to the first reset signal terminal and the second reset signal terminal, and the control electrode of the sixth transistor is electrically connected to the first reset signal terminal;

or the control electrode of the fifth transistor is electrically connected to the first reset signal terminal and the second reset signal terminal, and the control electrode of the sixth transistor is electrically connected to the first reset signal terminal and the second reset signal terminal.

4. The shift register according to claim 2, wherein the reset sub-circuit includes a fifth transistor, a sixth transistor and an eleventh transistor;

a control electrode of the fifth transistor is electrically connected to the first reset signal terminal, a first electrode of the fifth transistor is electrically connected to the third voltage signal terminal, and a second electrode of the fifth transistor is electrically connected to the pull-up node;

a control electrode of the sixth transistor is electrically connected to the first reset signal terminal, or the control electrode of the sixth transistor is electrically connected to the first reset signal terminal and the second reset signal terminal; a first electrode of the sixth transistor is electrically connected to the second voltage signal terminal, and a second electrode of the sixth transistor is electrically connected to the control node; and a control electrode of the eleventh transistor is electrically connected to the second reset signal terminal, a first electrode of the eleventh transistor is electrically connected to the third voltage signal terminal, and a second electrode of the eleventh transistor is electrically connected to the pull-up node.

5. The shift register according to claim 1, wherein the second voltage signal terminal is electrically connected to the third voltage signal terminal.

6. The shift register according to claim 1, wherein the input sub-circuit includes a first transistor;

a control electrode and a first electrode of the first transistor are electrically connected to the input signal terminal, and a second electrode of the first transistor is electrically connected to the pull-up node.

7. The shift register according to claim 1, wherein the control sub-circuit includes a second transistor and a capacitor;

a control electrode of the second transistor is electrically connected to the pull-up node, a first electrode of the second transistor is electrically connected to the clock signal terminal, and a second electrode of the second transistor is electrically connected to the control node; and one terminal of the capacitor is electrically connected to the control electrode of the second transistor, and another terminal of the capacitor is electrically connected to the control node.

8. The shift register according to claim 1, wherein the output sub-circuit includes a third transistor and a fourth transistor;

a control electrode and a first electrode of the third transistor are electrically connected to the first voltage signal terminal, and a second electrode of the third transistor is electrically connected to the first output signal terminal and a second electrode of the fourth transistor; and a control electrode of the fourth transistor is electrically connected to the control node, and a first electrode of the fourth transistor is electrically connected to the second voltage signal terminal.

9. The shift register according to claim 1, wherein the reset sub-circuit includes a fifth transistor and a sixth transistor;

a control electrode of the fifth transistor is electrically connected to the first reset signal terminal, a first electrode of the fifth transistor is electrically connected to the third voltage signal terminal, and a second electrode of the fifth transistor is electrically connected to the pull-up node; and a control electrode of the sixth transistor is electrically connected to the first reset signal terminal, a first electrode of the sixth transistor is electrically connected to the second voltage signal terminal, and a second electrode of the sixth transistor is electrically connected to the control node.

10. The shift register according to claim 1, wherein the denoising sub-circuit includes a seventh transistor, an eighth transistor, a ninth transistor and a tenth transistor;

a control electrode and a first electrode of the seventh transistor are electrically connected to the fourth voltage signal terminal, and a second electrode of the seventh transistor is electrically connected to a pull-down node;

a control electrode of the eighth transistor is electrically connected to the input signal terminal, a first electrode of the eighth transistor is electrically connected to the third voltage signal terminal, and a second electrode of the eighth transistor is electrically connected to the pull-down node;

a control electrode of the ninth transistor is electrically connected to the pull-up node, a first electrode of the ninth transistor is electrically connected to the third voltage signal terminal, and a second electrode of the ninth transistor is electrically connected to the pull-down node; and a control electrode of the tenth transistor is electrically connected to the pull-down node, a first electrode of the tenth transistor is electrically connected to the second voltage signal terminal, and a second electrode of the tenth transistor is electrically connected to the control node.

11. The shift register according to claim 1, further comprising a cascaded sub-circuit electrically connected to the pull-up node, a pull-down node, the third voltage signal terminal, the clock signal terminal and a second output signal terminal, wherein the cascaded sub-circuit is configured to transmit the clock signal from the clock signal terminal to the second output signal terminal in response to the signal received from the pull-up node, and to transmit the third voltage signal from the third voltage signal terminal to the second output signal terminal in response to a signal received from the pull-down node.

12. The shift register according to claim 11, wherein the cascaded sub-circuit includes a twelfth transistor and a thirteenth transistor;

a control electrode of the twelfth transistor is electrically connected to the pull-down node, a first electrode of the twelfth transistor is electrically connected to the third voltage signal terminal, and a second electrode of the twelfth transistor is electrically connected to the second output signal terminal; and a control electrode of the thirteenth transistor is electrically connected to the pull-up node, a first electrode of the thirteenth transistor is electrically connected to the clock signal terminal, and a second electrode of the thirteenth transistor is electrically connected to the second output signal terminal.

13. A light-emitting control circuit, comprising M stages of cascaded shift registers according to claim 11, M being an integer greater than 2; wherein a second output signal terminal that is electrically connected to a first-stage shift register is electrically connected to an input signal terminal that is electrically connected to a second-stage shift register;

a second output signal terminal that is electrically connected to an M-th-stage shift register is electrically connected to a first reset signal terminal that is electrically connected to an (M−1)-th-stage shift register; and except the first-stage shift register and the M-th-stage shift register, a second output signal terminal that is electrically connected to each stage shift register is electrically connected to a first reset signal terminal that is electrically connected to a previous-stage shift register and an input signal terminal that is electrically connected to a next-stage shift register.

14. A display apparatus, comprising at least one light-emitting control circuit according to claim 13.

15. A light-emitting control circuit, comprising M stages of cascaded shift registers according to claim 1, M being an integer greater than 2; wherein a control node of a first-stage shift register is electrically connected to an input signal terminal that is electrically connected to a second-stage shift register;

a control node of an M-th-stage shift register is electrically connected to a first reset signal terminal that is electrically connected to an (M−1)-th-stage shift register; and except the first-stage shift register and the M-th-stage shift register, a control node of each stage shift register is electrically connected to a first reset signal terminal that is electrically connected to a previous-stage shift register and an input signal terminal that is electrically connected to a next-stage shift register.

16. A display apparatus, comprising at least one light-emitting control circuit according to claim 15.

17. A method for driving the shift register according to claim 1, comprising:

in a first period of an image frame:

transmitting, by the input sub-circuit, the input signal from the input signal terminal to the pull-up node in response to the received input signal;

transmitting, by the control sub-circuit, the clock signal from the clock signal terminal to the control node in response to the signal received from the pull-up node; and transmitting, by the output sub-circuit, the first voltage signal from the first voltage signal terminal to the first output signal terminal in response to the received first voltage signal;

in a second period of the image frame:

transmitting, by the control sub-circuit, the clock signal from the clock signal terminal to the control node in response to the signal received from the pull-up node; and transmitting, by the output sub-circuit, the second voltage signal from the second voltage signal terminal to the first output signal terminal in response to the clock signal received from the control node; and in a third period of the image frame:

transmitting, by the reset sub-circuit, the second voltage signal from the second voltage signal terminal to the control node to reset the control node in response to the first reset signal received from the first reset signal terminal;

transmitting, by the reset sub-circuit, the third voltage signal from the third voltage signal terminal to the pull-up node to reset the pull-up node in response to the first reset signal received from the first reset signal terminal; and transmitting, by the output sub-circuit, the first voltage signal from the first voltage signal terminal to the first output signal terminal in response to the received first voltage signal.

18. The method according to claim 17, wherein the reset sub-circuit is further electrically connected to a second reset signal terminal; the method further comprises:

in a fourth period of the image frame:

transmitting, by the reset sub-circuit, the second voltage signal from the second voltage signal terminal to the control node to reset the control node in response to a second reset signal received from the second reset signal terminal, and/or transmitting, by the reset sub-circuit, the third voltage signal from the third voltage signal terminal to the pull-up node to reset the pull-up node in response to the second reset signal received from the second reset signal terminal; and transmitting, by the output sub-circuit, the first voltage signal from the first voltage signal terminal to the first output signal terminal in response to the received first voltage signal.

19. The method according to claim 17, wherein the shift register further includes a denoising sub-circuit; the denoising sub-circuit is electrically connected to a fourth voltage signal terminal, the input signal terminal, the pull-up node, the second voltage signal terminal, the third voltage signal terminal and the control node; and the method further comprises:

in the first period of the image frame:

controlling, by the denoising sub-circuit, a line between the control node and the second voltage signal terminal to be opened in response to the input signal received from the input signal terminal and the signal on the pull-up node and under a control of the third voltage signal from the third voltage signal terminal;

in the second period of the image frame:

controlling, by the denoising sub-circuit, the line between the control node and the second voltage signal terminal to be opened in response to the signal received from the pull-up node and under the control of the third voltage signal from the third voltage signal terminal; and in the third period of the image frame:

controlling, by the denoising sub-circuit, the line between the control node and the second voltage signal terminal to be closed to transmit the second voltage signal from the second voltage signal terminal to the control node, in response to a fourth voltage signal received from the fourth voltage signal terminal.

* * * * *